US007279271B2

(12) United States Patent
Hakii

(10) Patent No.: US 7,279,271 B2
(45) Date of Patent: Oct. 9, 2007

(54) COLOR MATERIAL AND SILVER HALIDE COLOR PHOTOGRAPHIC LIGHT-SENSITIVE MATERIAL

(75) Inventor: Takeshi Hakii, Sagamihara (JP)

(73) Assignee: Konica Minolta Photo Imaging Inc., Tokyo (JP)

( * ) Notice: Subject to any disclaimer, the term of this patent is extended or adjusted under 35 U.S.C. 154(b) by 0 days.

(21) Appl. No.: 10/549,553

(22) PCT Filed: Mar. 25, 2003

(86) PCT No.: PCT/JP03/03607

§ 371 (c)(1),
(2), (4) Date: Sep. 20, 2005

(87) PCT Pub. No.: WO2004/086141

PCT Pub. Date: Oct. 7, 2004

(65) Prior Publication Data

US 2006/0177779 A1 Aug. 10, 2006

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/46*** | (2006.01) |

(52) U.S. Cl. ..... 430/551; 430/543; 430/546; 430/502; 430/503; 430/556; 430/557; 430/558

(58) Field of Classification Search ..... 430/502, 430/503, 543, 556, 557, 558, 546, 551
See application file for complete search history.

(56) References Cited

U.S. PATENT DOCUMENTS

| | | | |
|---|---|---|---|
| 6,071,686 | A | 6/2000 | Cowan |
| 2002/0022202 | A1 | 2/2002 | Helling |

FOREIGN PATENT DOCUMENTS

| | | |
|---|---|---|
| EP | 1014189 | 6/2000 |
| EP | 1191396 | 3/2002 |
| JP | 3287254 | 12/1991 |
| JP | 4178647 | 6/1992 |
| JP | 5072664 | 3/1993 |
| JP | 6250324 | 9/1994 |
| JP | 0762197 | 9/1997 |
| JP | 2003005330 | 1/2003 |

*Primary Examiner*—Geraldina Visconti
(74) *Attorney, Agent, or Firm*—Lucas & Mercanti, LLP

(57) ABSTRACT

The present invention provides a color material and a silver halide color photographic light-sensitive material, particularly, a color material and a silver halide color photographic light-sensitive material which are excellent in a coloring capability, processing stability, dye image fastness and a white background. This invention is characterized by containing at least one type of compounds represented by formula (A) in at least one layer on a reflective or transparent support Formula (A)

16 Claims, No Drawings

COLOR MATERIAL AND SILVER HALIDE COLOR PHOTOGRAPHIC LIGHT-SENSITIVE MATERIAL

FIELD OF THE INVENTION

The present invention relates to a color material and a silver halide color photographic light-sensitive material (hereinafter, also referred to simply as a light-sensitive material), particularly to a color material and a silver halide photographic light-sensitive material which are excellent in a coloring capability, processing stability, fastness of a dye image and a white background.

BACKGROUND OF THE INVENTION

Silver halide color photographic light-sensitive material has been generally utilized as a material to provide high quality images of stable quality at low cost, and user's demands for higher image quality and more stable quality are more and more increasing. With respect to request for higher image quality, improvements in such as color reproducibility, tone reproducibility, a white background, fastness of a dye image and sharpness have been desired, and with respect to more stable quality, improvements in such as manufacturing stability of a light-sensitive material, stability during aging storage in an unexposed state and a capability variation at the time of processing are required. In particular, in accordance with a trend of rapid processing and decreased replenishing quantity in recent years, improvement of stabilized capabilities against variation of the processing in the market is still more strongly required.

With respect to request for a higher image quality, a cyan dye forming coupler of a pyrazolotriazole type, which overcomes a defect of absorption characteristics of a phenol type or naphthol type cyan dye coupler, has been proposed, however, there has been a problem of inferior light fastness of an image dye formed from a cyan dye forming coupler of a pyrazolotriazole type.

To overcome this problem, an improvement technique by a dye image stabilizer has been studied, and such as phenol type compounds, amine type compounds or phenylether type compounds are disclosed (for example, refer to Patent Documents 1-3).

However, in the case of employing these techniques, it has been proved that although fading by light of an image dye formed from a cyan dye forming coupler of a pyrazolotriazole type is decreased, generated may be a problem that bleeding of a dye image and an inter-layer transfer of a coupler due to an increased oil-soluble component incorporated with addition of a dye image stabilizer and a quality defect of increased variation of a white background depending on various processing in the market.

The present invention has been made in view of the above described background.

Patent Document 1: JP-A 9-50101 (hereinafter, JP-A refers to Unexamined Japanese Patent Application Publication)

Patent Document 2: JP-A 9-230553

Patent Document 3: JP-A 2001-356456

SUMMARY OF THE INVENTION

An object of the present invention is to provide a color material or a silver halide color photographic light-sensitive material which are excellent in coloring capability, processing stability, fastness of dye images and white background.

The object of the invention can be achieved by the following color material or silver halide photographic light-sensitive material.

Item 1. A color material comprising a reflective or a transparent support having thereon a layer comprising a compound represented by formula (A):

Formula (A)

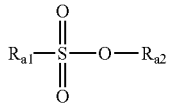

wherein, $R_{a1}$ and $R_{a2}$ are each an alkyl group, a cycloalkyl group, an alkenyl group, an aryl group or a heterocyclic group, provided that each group may be further provided with a substituent.

Item 2. A silver halide color photographic light-sensitive material satisfying a requirement of Item 1.

Item 3. The silver halide color photographic light-sensitive material of Item 2, wherein $R_{a1}$ of formula (A) is an alkyl group and $R_{a2}$ is a substituted or unsubstituted aryl group.

Item 4. The silver halide color photographic light-sensitive material of Item 2 further comprising a yellow dye forming coupler, a magenta dye forming coupler or a cyan dye forming coupler in at least one layer.

Item 5. The silver halide color photographic light-sensitive material of Item 4 further comprising at least one of couplers represented by formula (I):

Formula (I)

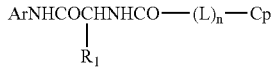

wherein, Ar is an aryl group or a heterocyclic group, $R_1$ is an alkyl group, an aryl group or a heterocyclic group; L is a divalent linking group and n is an integer of 0 or 1; and Cp is a coupler residual group.

Item 6. The silver halide color photographic light-sensitive material of Item 4 further comprising at least one type of couplers represented by formula (II):

Formula (II)

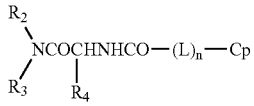

wherein, $R_1$, $R_2$ and $R_3$ are each an alkyl group, an aryl group or a heterocyclic group; L is a divalent connecting group; n is an integer of 0 or 1; and Cp is a coupler residual group.

Item 7. The silver halide color photographic light-sensitive material of Item 4 further comprising at least one type of couplers represented by formula (III):

Formula (III)

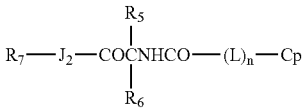

wherein, $R_5$ is an unsubstituted alkyl group having a carbon number of not less than 5; $R_6$ is a hydrogen atom, an alkyl group, an aryl group or a heterocyclic group; $R_7$ is an alkyl group, an aryl group or a heterocyclic group; J is —O— or —$NR_{11}$—; $R_{11}$ is a hydrogen atom, an alkyl group, an aryl group or a heterocyclic group; L is a divalent connecting group; n is an integer of 0 or 1; and Cp is a coupler residual group.

Item 8. The silver halide color photographic light-sensitive material of Item 4, wherein the coupler residual group Cp of formula (I), formula (II) or formula (III) is represented by formula (IV):

Formula (IV)

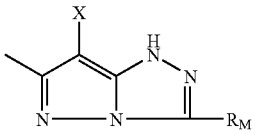

wherein, X is a hydrogen atom, a halogen atom or a group, which is released by coupling with an oxidant of a color developing agent; and $R_M$ is a mono-valent substituent.

Item 9. The silver halide color photographic light-sensitive material of Item 8, wherein a phenol type cyan coupler is contained in the same layer containing a coupler provided with a coupler residual group represented by formula (IV).

DETAILED DESCRIPTION OF THE INVENTION

The present invention is characterized by containing at least one type of compounds represented by aforesaid formula (A) in at least one layer on a reflective or transparent support.

Compounds represented by aforesaid formula (A) will be now explained.

In aforesaid formula (A), $R_{a1}$ is an alkyl group, a cycloalkyl group, an alkenyl group, an aryl group or a heterocyclic group, and each substituent may be further provided with a substituent; a preferable substituent is an alkyl group having a carbon number of 8-24 and more preferably a straight chain substituent having a carbon number of 12-24.

$R_{a2}$ is an alkyl group, a cycloalkyl group, an alkenyl group, an aryl group or a heterocyclic group, and each substituent may be further provided with a substituent; preferable substituent is an aryl group or an alkyl substituted aryl group.

The molecular weight of aforesaid formula (A) is preferably 250-600 and more preferably 300-500.

In the following, specific examples of compounds represented by aforesaid formula (A) will be shown; however, this invention is not limited thereto.

A-1

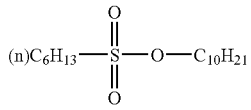

A-2

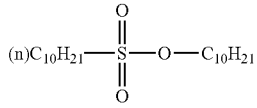

A-3

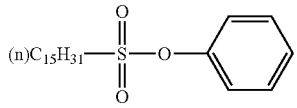

A-4

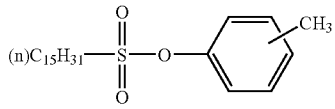

A-5

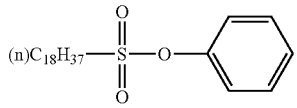

A-6

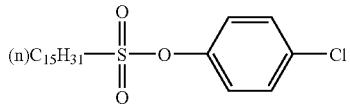

A-7

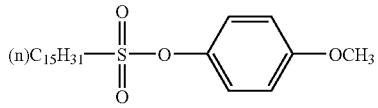

A-8

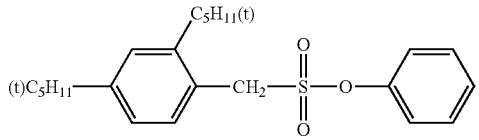

A-9

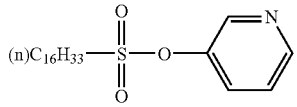

A-10

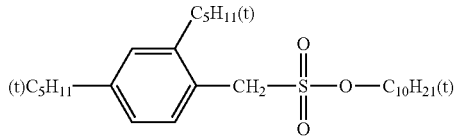

A-11

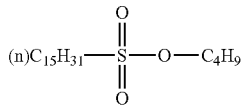

A-12

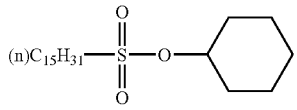

-continued

A-13

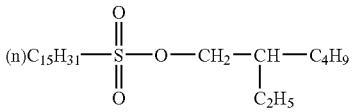

A-14

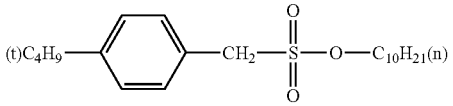

A-15

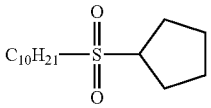

Compounds represented by formula (A) of this invention can be utilized generally in a range of $1\times10^{-2}$–10 and preferably in a range of $1\times10^{-1}$–3, against a coupler based on a weight ratio.

Next, a cyan coupler represented by aforesaid formula (I) according to this invention will be explained.

In aforesaid formula (I), Ar is an aryl group or a heterocyclic group. Aryl groups represented by Ar include a phenyl group or a naphthyl group.

Heterocyclic groups represented by Ar are preferably 5-7-membered, and specifically include a 2-furyl group, a 2-thienyl group, a 2-pyrimidinyl group, a 2-benzothiazolyl group, a 1-pyrolyl group and a 1-tetrazonyl group.

Aryl groups and heterocyclic groups represented by Ar may be further provided with a substituent, and the substituent is not specifically limited and includes, for example, each group of alkyl, aryl, aniline, acylamino, sulfonamindo, alkylthio, arylthio, alkenyl and cycloalkenyl, in addition to each group of such as a halogen atom, cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro, and sulfo; and a spiro compound residual group and a bridge-containing hydrocarbon compound residual group.

In formula (I), $R_1$ is preferably-an alkyl group or an aryl group, more preferably an alkyl group and most preferably an unsubstituted alkyl group.

In formula (I), L is a divalent connecting group and preferably an alkylene group or an arylene group; n is an integer of 0 or 1 and preferably 0.

In formula (I), among coupler residual groups represented by Cp, pyrazolotriazoles are preferable as a coupler residual group and coupler residual groups represented by aforesaid formula (IV) are more preferable.

In formula (IV), X is a hydrogen atom, a halogen atom or a group which is capable of reacting with an oxidant of a color developer to be released.

An atom or a group, which is represented by X and capable of reacting with an oxidant of a color developer to be released, include, for example, each group of a hydrogen atom, a halogen atom (such as chlorine, bromine and iodine), alkyleneoxy, alkoxy, aryloxy, heterocyclic oxy, acyloxy, sulfonyloxy, alkoxycarbonyloxy, aryloxycarbonyl, alkyloxzalyloxy, alkoxyoxzalyloxy, alkylthio, arylthio, heterocyclic thio, alkyloxythiocarbonylthio, acylamino, sulfonamide, a nitrogen-containing heterocyclic ring each bonds via a nitrogen atom, alkyloxycarbonylamino, aryloxycarbonylamino and carboxyl, and preferable among them are a hydrogen atom, a halogen atom, an alkoxy group and an aryloxy group.

In formula (IV), $R_M$ is a mono-valent substituent. Substituents represented by $R_M$ are not specifically limited, however, typical examples include each group of alkyl, aryl, anilino, acylamino, sulfonamindo, alkylthio, arylthio, alkenyl and cycloalkenyl, in addition to each group of such as a halogen atom, cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro, and sulfo; and a spiro compound residual group and a bridge-containing hydrocarbon compound residual group.

Furthermore specifically, alkyl groups represented by $R_M$ are preferably those having-a carbon number of 1-32 and may be either of straight chained or branched.

Aryl groups represented by $R_M$ are preferably a phenyl group.

Acylamino groups include such as an alkylcarbonylamino group and an arylcarbonylamino group.

Sulfonamido groups represented by $R_M$ include such as an alkylsulfonylamino group and an arylsulfonylamino group. Alkyl components and aryl components in an alkylthio group and an arylthio group include alkyl groups and aryl groups represented by aforesaid $R_M$.

Alkenyl groups represented by $R_M$ preferably have a carbon number of 2-32, cycloalkyl groups preferably have a carbon number of 3-12 and specifically preferably of 5-7, and alkenyl groups may be either of straight chained or branched.

Cycloalkenyl groups represented by $R_M$ preferably have a carbon number of 3-12 and specifically preferably of 5-7. Sulphonyl groups include such as an alkylsulfonyl group and an arylsulfonyl group.

Sulfinyl groups represented by $R_M$ include such as an alkylsulfinyl group and an arylsulfinyl group.

Phosphonyl groups represented by $R_M$ include such as an alkylphosphonyl group, an alkoxyphosphonyl group, an aryloxyphosphonyl group and an arylphosphonyl group.

Acyl groups represented by $R_M$ include such as an alkylcarbonyl group and an arylcarbonyl group.

Carbamoyl groups represented by $R_M$ include such as an alkylcarbamoyl group and an arylcarbamoyl group.

Sulfamoyl groups represented by $R_M$ include such as an alkylsulfamoyl group and an arylsulfamoyl group.

Acyloxy groups represented by $R_M$ include such as an alkylcarbonyloxy group and an arylcarbonyloxy group. sulfonyloxy groups include such as an aklkyl sulfonyloxy group and an arylsulfonyloxy group.

Carbamoyloxy groups represented by $R_M$ include such as an alkylcarbamoyloxy group and an arylcarbamoyloxy group.

Ureido groups represented by $R_M$ include such as an alkylureido group and arylureido group. Sulfamoylamino groups include such as an alkylsulfamoylamino and arylsulfamoylamino.

Heterocyclic groups represented by $R_M$ preferably those of 5-7-membered, and specifically include such as a 2-furyl group, a 2-thienyl group, a 2-pyridinyl group, a 2-benzothiazolyl group, a 1-pyrolyl group and a 1-tetrazolidinyl.

Heterocyclic oxy groups represented by $R_M$ are preferably those having a 5-7 member hetero ring, and include such as a 3,4,5,6-tetrahydropyranyl-2-oxy group and 1-phenyltetrazole-5-oxy group.

Heterocyclic thio groups represented by $R_M$ are preferably 5-7 member heterocyclicthio groups, and include such as a 2-benzothiazolylthio group and a 2,4-diphenoxy-1,3-5-triazole-6-thio group.

Siloxy groups represented by $R_M$ include such as a trimethylsiloxy group, triethylsiloxy group and a dimethylbutylsiloxy group.

Imido groups represented by $R_M$ include such as a succinic acid imido group, a 3-heptadecyl succinic acid imido group, a phthalimido group and a glutalimido group.

Spiro compound residual groups represented by $R_M$ include such as a spiro [3,3]heptane-1-yl. Bridge-containing hydrocarbon residual groups include such as bicyclo[2,2,1]heptane-1-yl, tricyclo[3,3,1,$1^{3,7}$]-decane-1-yl and 7,7-dimethyl-bicyclo[2,2,1]heptane-1-yl.

Substituents represented by $R_M$ are preferably an alkyl group or an aryl group, and specifically preferably an aryl group.

Cyan couplers represented by aforesaid formula (II) according to this invention will now be explained.

In aforesaid formula (II), $R_2$, $R_3$ and $R_4$ represent an alkyl group, an aryl group or a heterocyclic group, and typical examples thereof include such as a methyl group, an ethyl group, an isopropyl group, a butyl group and a dodecyl group, as alkyl groups. A phenyl group is listed as aryl groups. As heterocyclic groups, those of 5-7-membered are preferable and specific examples include a 2-furyl group, a 2-thienyl group, a 2-pyrimidyl group, a 2-benzothiazolyl group, a 1-pyrolyl group and a 1-tetrazolidinyl group.

In formula (II), $R_2$, $R_3$ and $R_4$ are preferably an alkyl group or an aryl group.

In formula (II), $R_4$ is preferably an alkyl group or an aryl group, more preferably an alkyl group and most preferably an unsubstituted alkyl group.

In formula (II), L is a divalent connecting group, and preferably an alkylene group or an arylene group; n is an integer of 0 or 1 and preferably 0.

In formula (II), Cp is a coupler residual group, and typical examples of coupler residual groups represented by Cp are described in such as U.S. Pat. Nos. 2,367,531, 2,423,730, 2,772,162, 2,895,826, 3,002,826, 3,034,892, 3,041,236, JP-A No. 64-554 and Agfa Mitteilung (Band II) pp. 156-175 (1961).

Among these, preferable are phenols cyan couplers, naphthols cyan couplers, pyrrolotriazoles cyan couplers or pyrazolotriazoles cyan couplers.

In formula (II), among coupler residual groups represented by. Cp, pyrazolotriazoles are more preferable as a coupler residual group and coupler residual groups represented by aforesaid formula (IV) are specifically preferable.

Next, cyan couplers represented by aforesaid formula (III) according to this invention will be explained.

In formula (III), $R_5$ is an unsubstituted alkyl group having a carbon number of not less than 5, of either a branched or straight chained, and include, for example, a hexyl group, an octyl group, a decyl group, a dodecyl group and 1,1,3-trimethylbutyl group.

In formula (III), $R_6$ is a hydrogen atom, an alkyl group, an aryl group or a heterocyclic group, and typical examples of an alkyl group, an aryl group and a heterocyclic group represented by $R_6$ include groups similar to Ar in formula (I).

In formula (III), $R_6$ preferably is a hydrogen atom, an alkyl group and more preferably a hydrogen atom.

In formula (III), $R_7$ preferably is an alkyl group or an aryl group.

In formula (III), $J_2$ preferably is —$NR_{11}$—. $R_{11}$ is a hydrogen atom, an alkyl group, an aryl group or a heterocyclic group, and typical examples of an alkyl group, an aryl group and a heterocyclic group are identical to $R_2$, $R_3$ and $R_4$ in formula (II).

In formula (III), L is a divalent connecting group, and preferably an alkylene group or an arylene group.

In formula (III), n is an integer of 0 or 1 and preferably 0.

In formula (III), Cp is a coupler residual groups, and coupler residual groups represented by Cp include groups similar to coupler residual groups represented by Cp in formula (II).

In formula (III), among coupler residual groups represented by Cp, pyrazolotriazoles are preferable as a coupler residual group and coupler residual groups represented by aforesaid formula (IV) are more preferable.

Next, specific examples of couplers represented by aforesaid formulas (I)-(III) will be shown, however, this invention is not limited thereto.

(1-1)

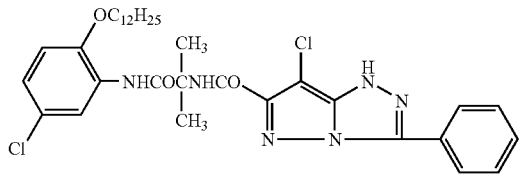

(1-2)

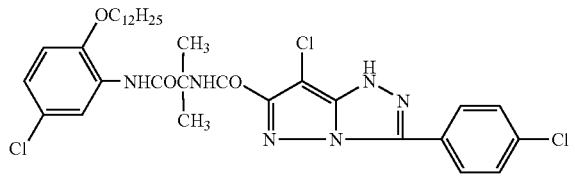

(1-3)

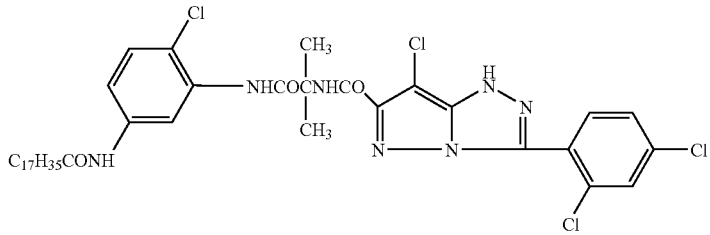

-continued
(1-4)
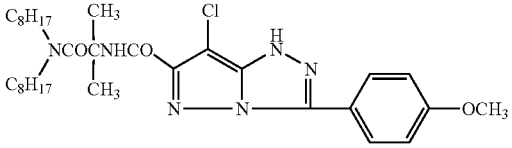
(1-5)
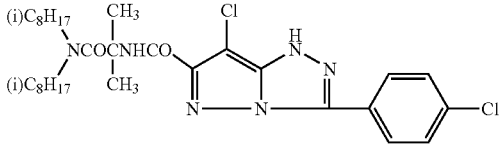
(1-6)
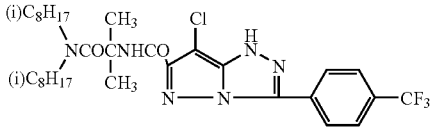
(1-7)
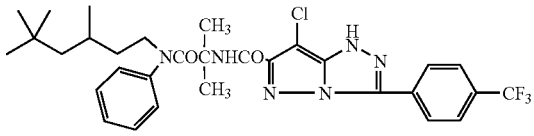
(1-8)
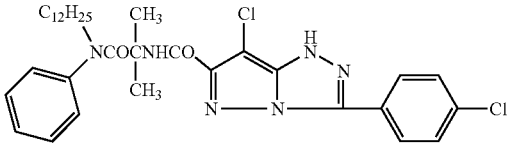
(1-9)
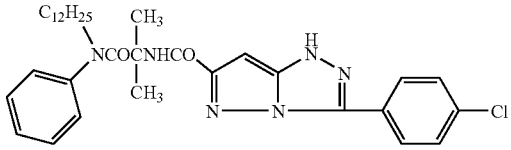
(1-10)
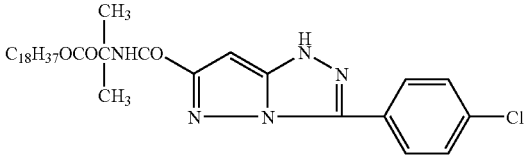
(1-11)
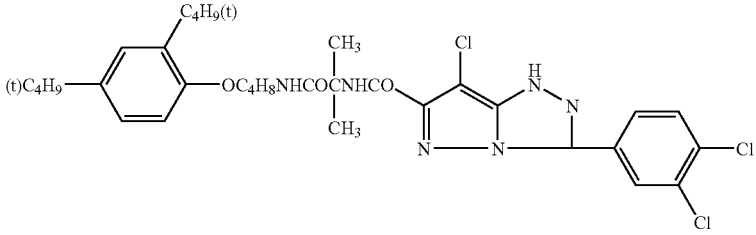
(1-12)
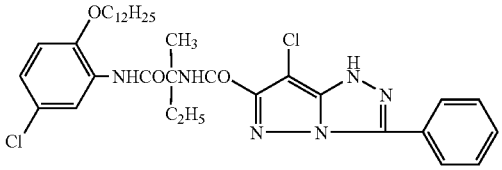
(1-13)
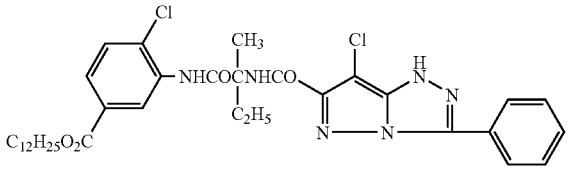
(1-14)
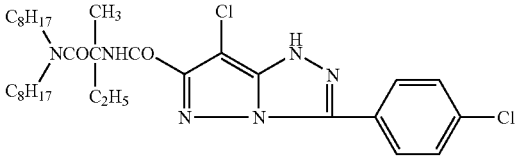
(1-15)
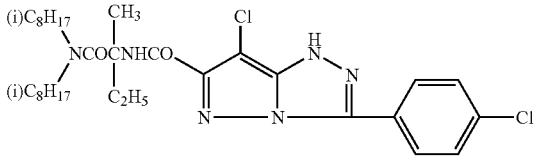
(1-16)
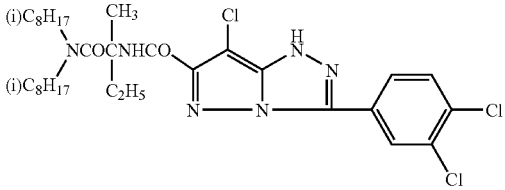
(1-17)
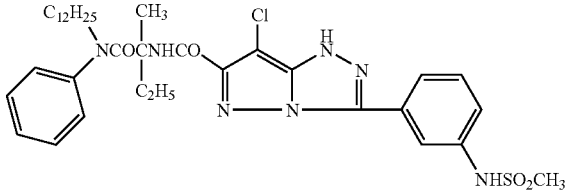

-continued
(1-18)
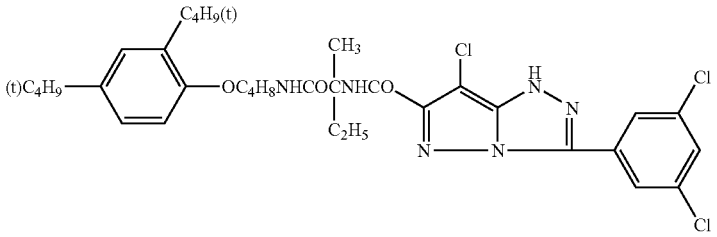
(1-19)
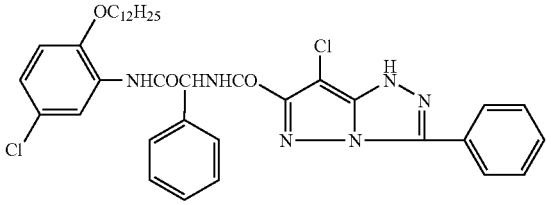
(1-20)
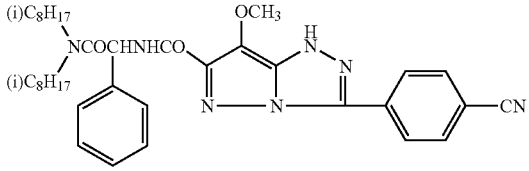
(1-21)
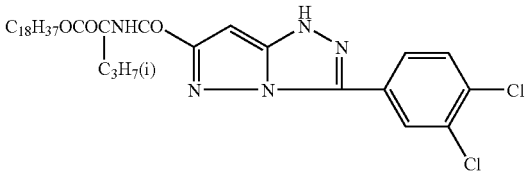
(1-22)
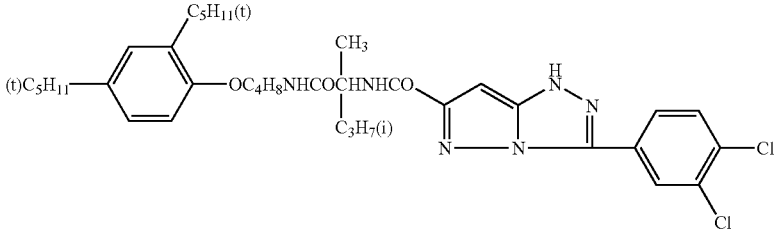
(2-1)
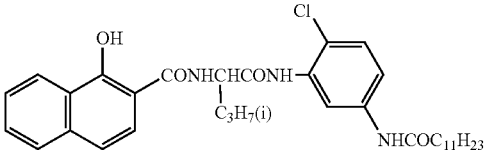
(2-2)
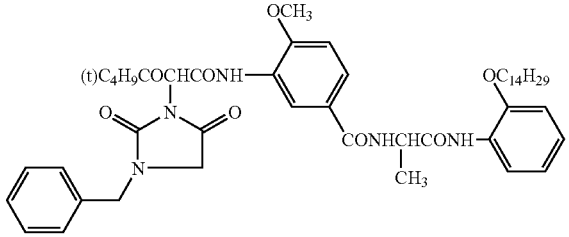
(2-3)
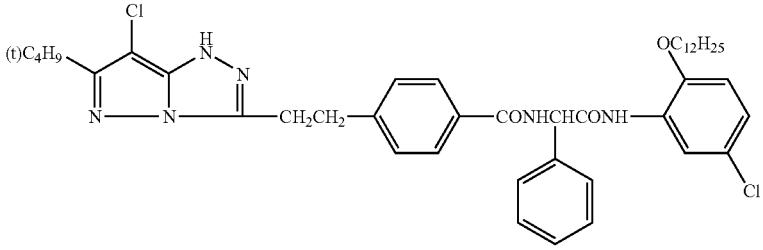
(2-4)
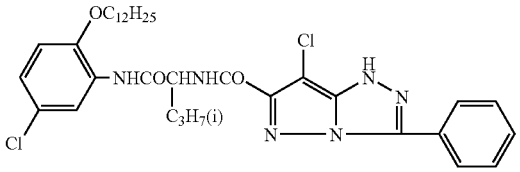
(2-5)
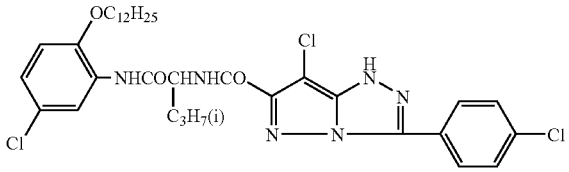

-continued
(2-6)
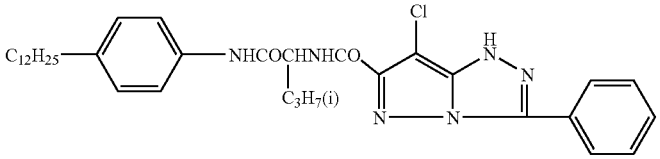
(2-7)
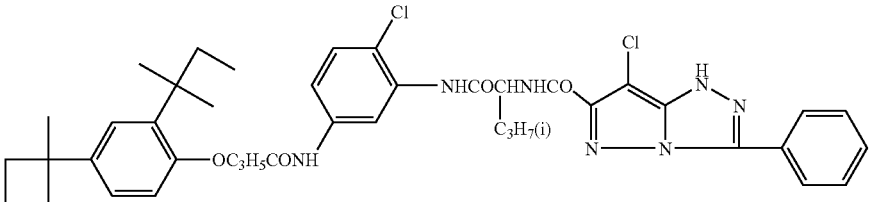
(2-8)
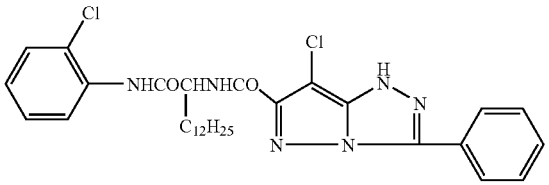
(2-9)
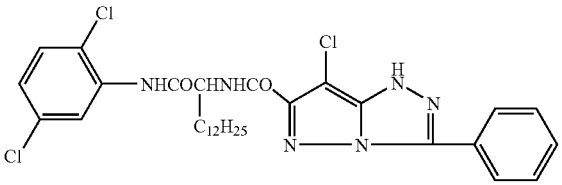
(2-10)
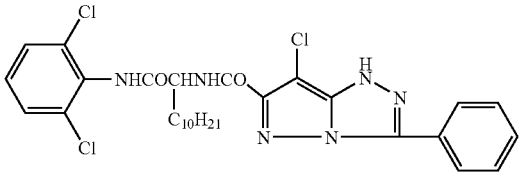
(2-11)
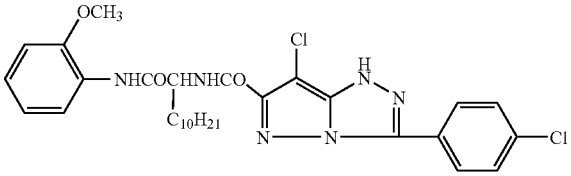
(2-12)
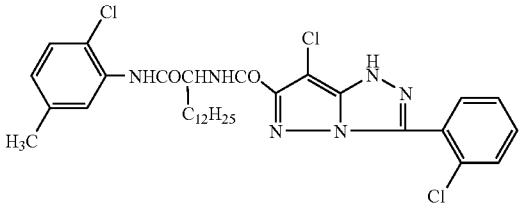
(2-13)
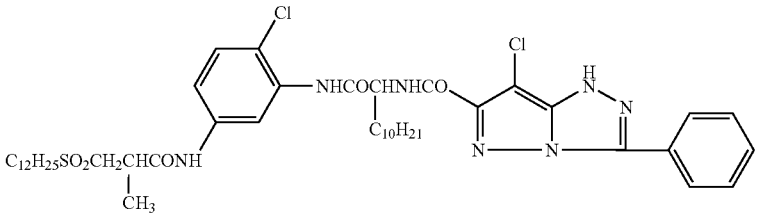
(2-14)
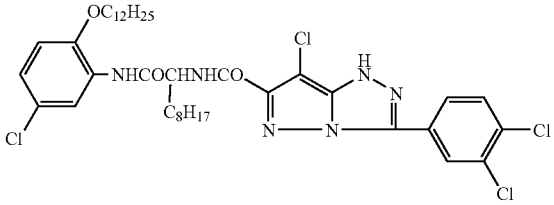
(2-15)
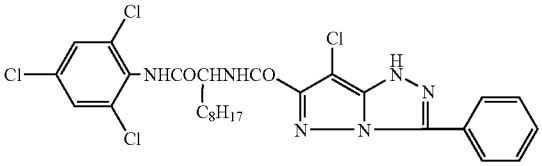

-continued
(2-16)
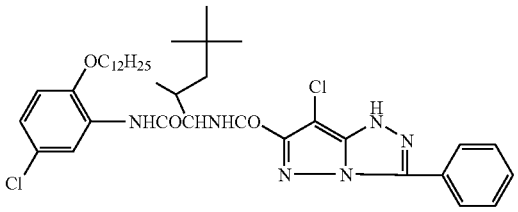
(2-17)
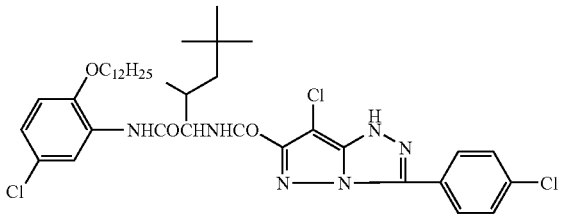
(2-18)
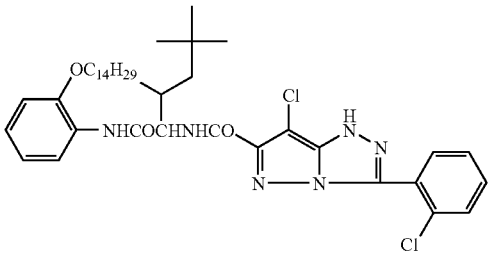
(2-19)
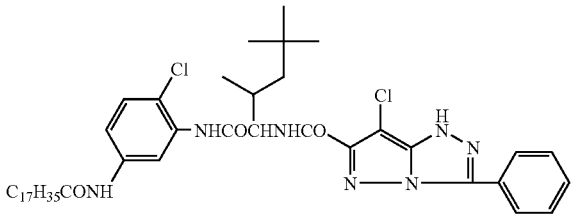
(2-20)
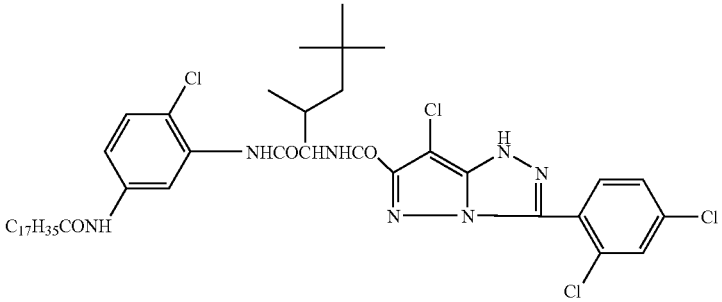
(2-21)
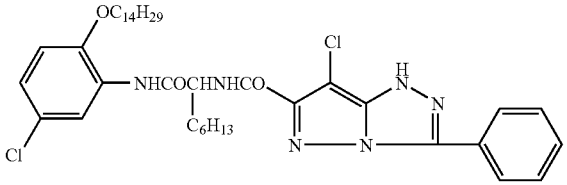
(2-22)
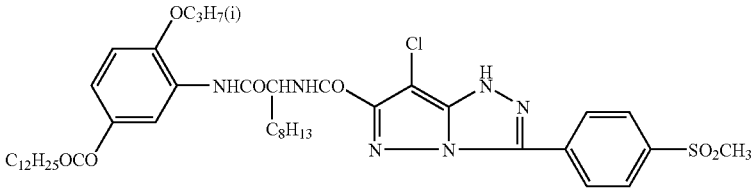
(2-23)
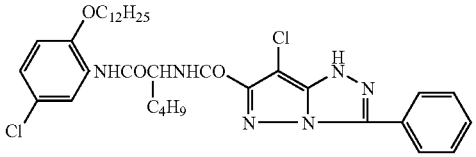
(2-24)
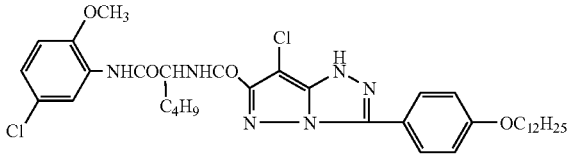
(2-25)
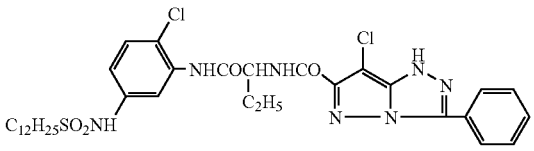
(2-26)
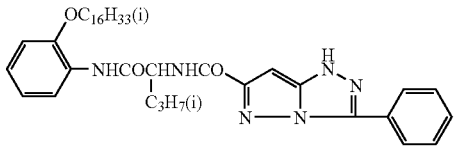

-continued
(2-27)
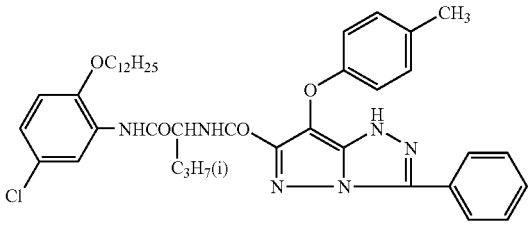
(2-28)
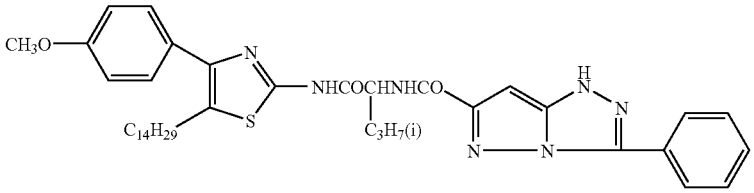
(2-29)
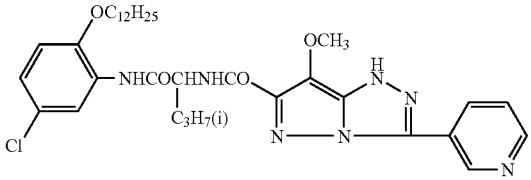
(3-1)
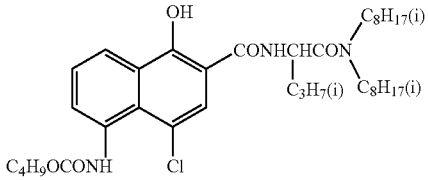
(3-2)
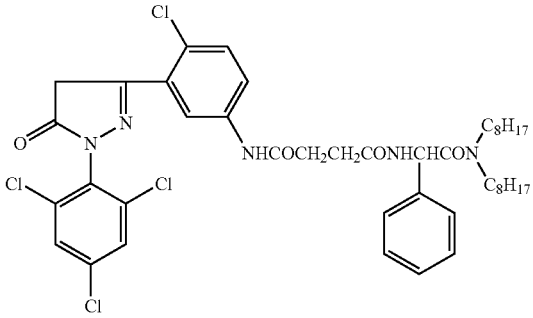
(3-3)
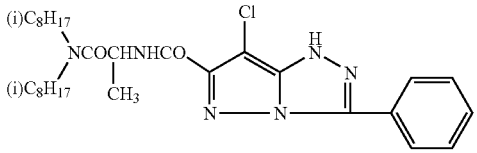
(3-4)
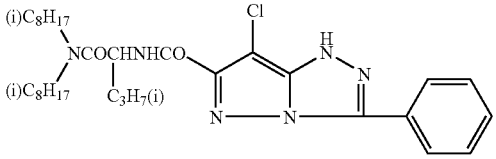
(3-5)
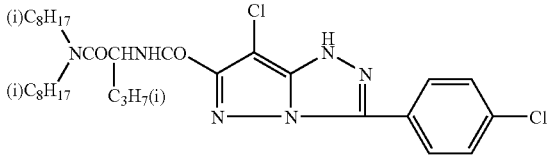
(3-6)
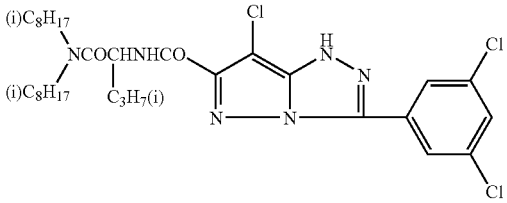
(3-7)
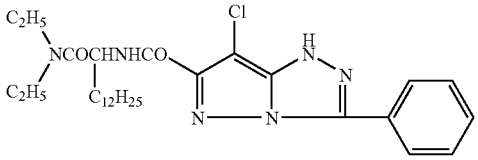
(3-8)
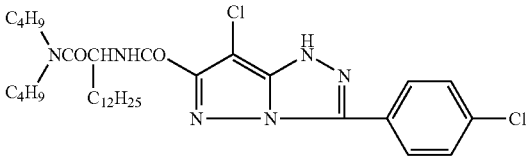
(3-9)
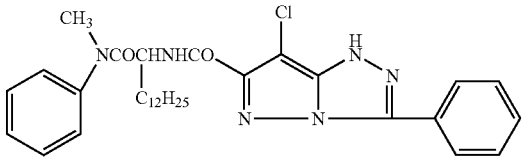

-continued
(3-10)
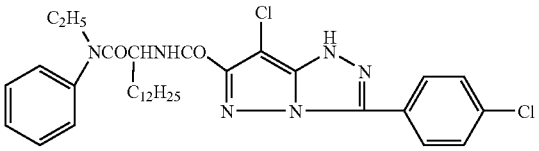
(3-11)
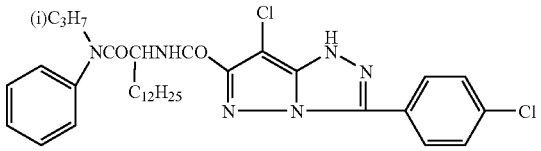
(3-12)
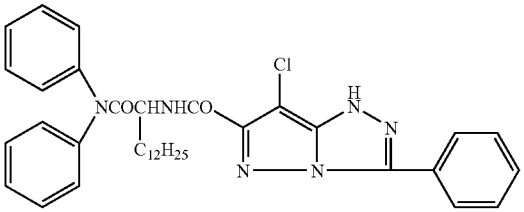
(3-13)
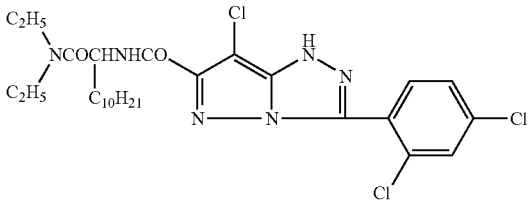
(3-14)
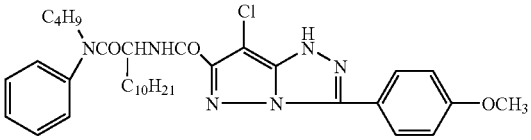
(3-15)
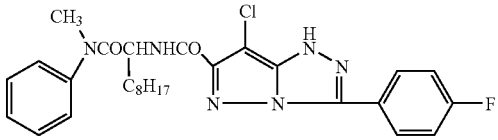
(3-16)
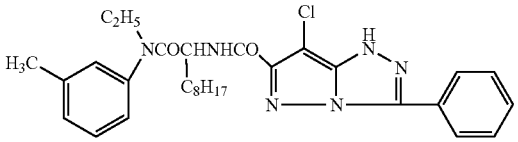
(3-17)
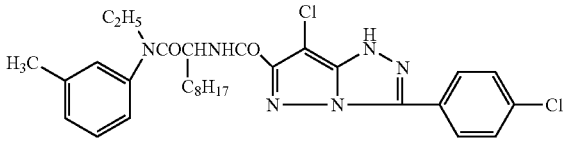
(3-18)
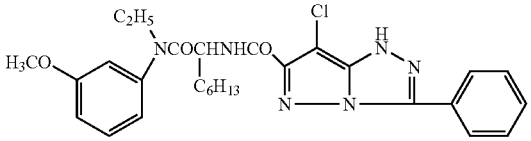
(3-19)
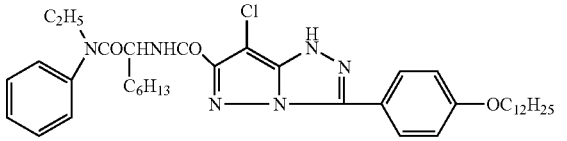
(3-20)
(3-21)
(3-22)
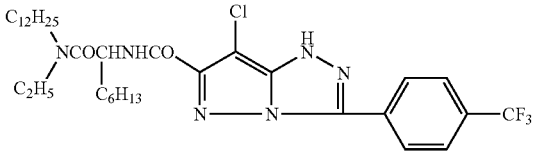
(3-23)
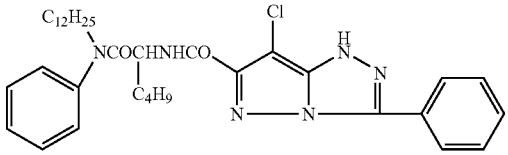
(3-24)
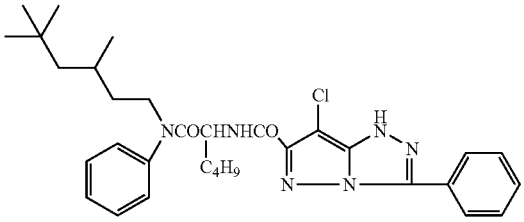
(3-25)
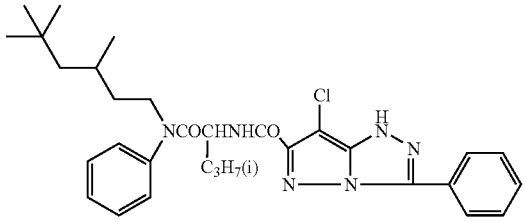
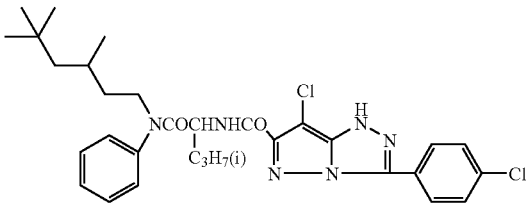
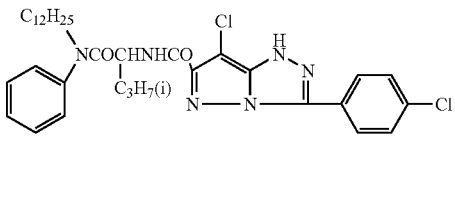

-continued
(3-26)
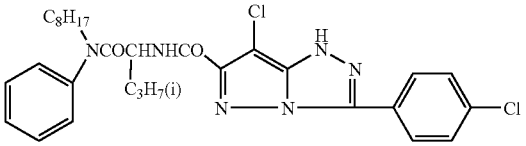
(3-27)
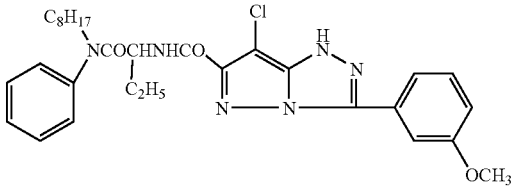
(3-28)
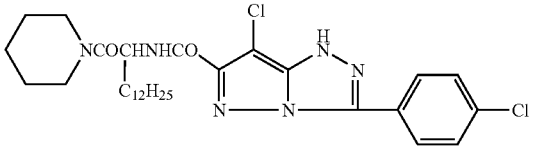
(3-29)
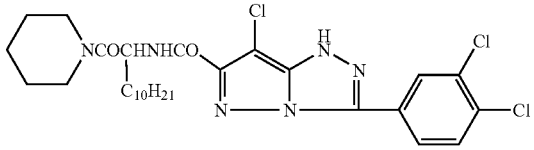
(3-30)
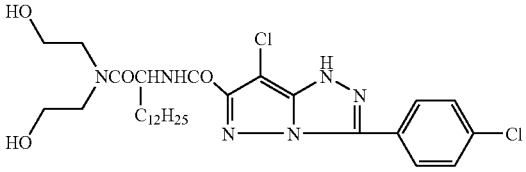
(4-1)
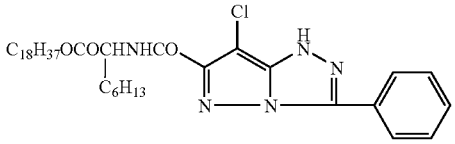
(4-2)
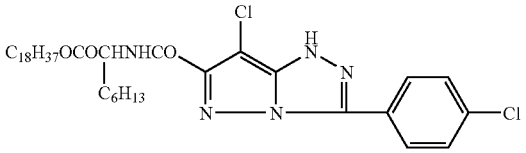
(4-3)
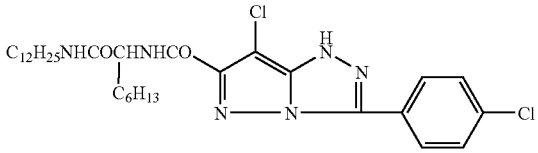
(4-4)
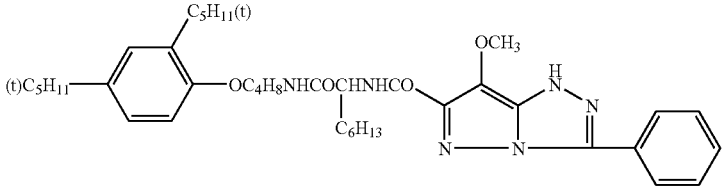
(4-5)
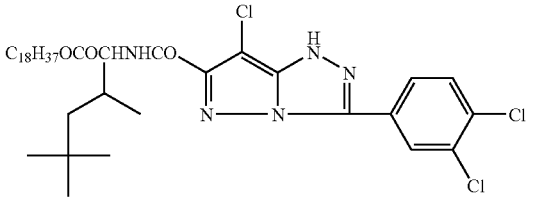
(4-6)
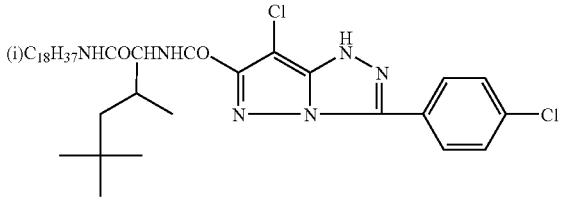
(4-7)
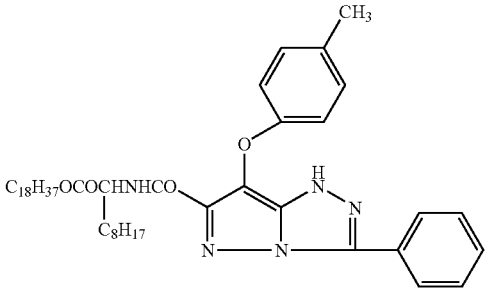
(4-8)
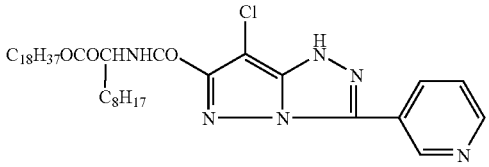

-continued
(4-9)
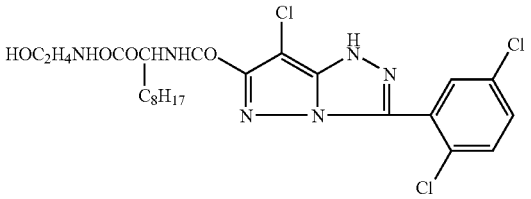
(4-10)
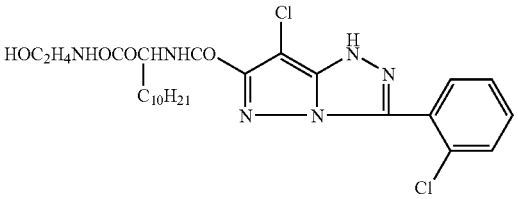
(4-11)
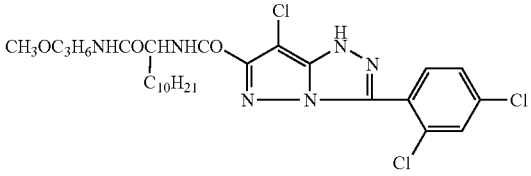
(4-12)
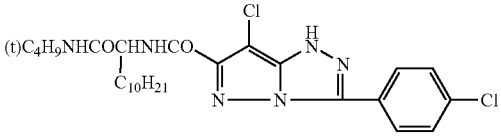
(4-13)
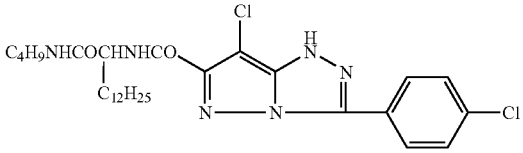
(4-14)
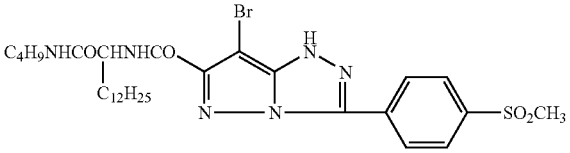
(4-15)
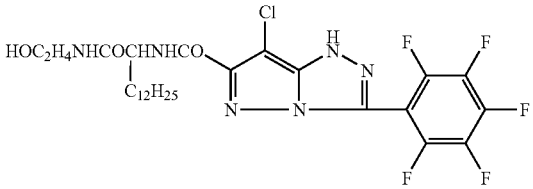
(4-16)
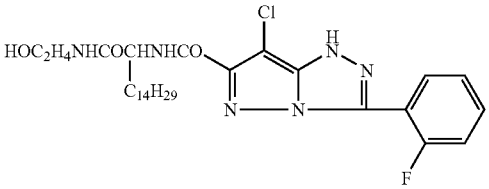
(4-17)
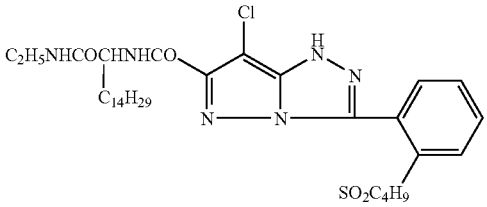
(4-18)
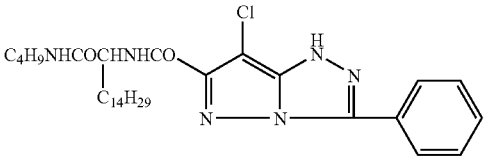
(4-19)
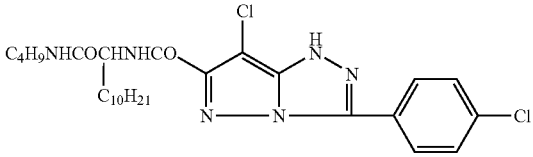
(4-20)
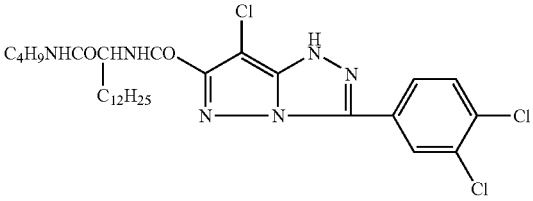

-continued (4-21)

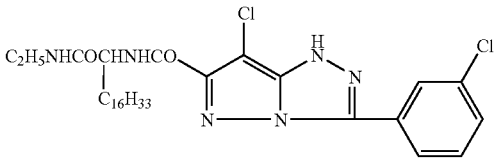

(4-22)

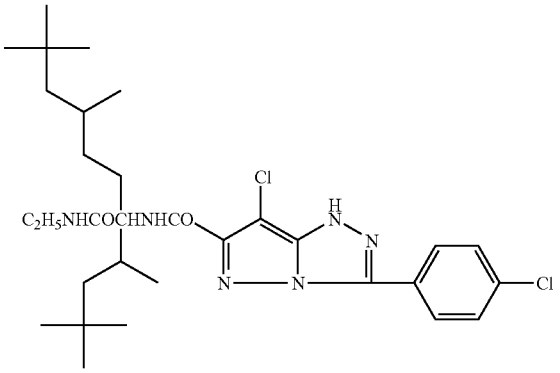

(4-23)

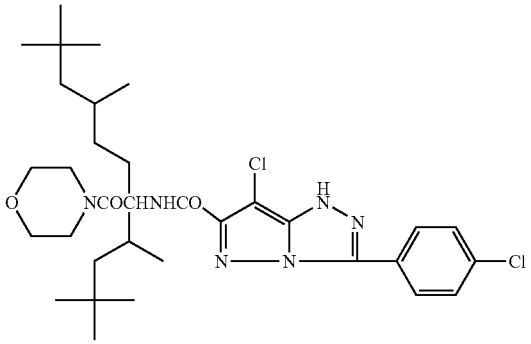

(4-24)

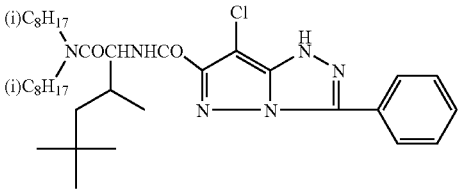

A cyan coupler of this invention can be generally utilized in a range of $1\times10^{-3}$-1 mol and preferably of $1\times10^{-2}$-$8\times10^{-1}$ mol, per 1 mol of silver halide. A cyan coupler may be mixed with a high boiling point organic solvent having a boiling point of not lower than ° C. or a water-insoluble polymer compound, appropriately employing a low boiling point organic solvent (such as ethyl acetate) or a water-soluble organic solvent in combination, to be dissolved by being heated at not lower than 80° C., followed by being emulsifying dispersed in a hydrophilic binder such as a gelatin aqueous solution in the presence of a surfactant by use of a dispersion means, such as a stirrer, a homogenizer, a colloidal mill, a flow jet mixer and an ultrasonic apparatus, and then the resulting dispersion is incorporated in an aimed hydrophilic colloidal layer. In the case of utilizing a low boiling point organic solvent, it is preferable to apply a process to eliminate the low boiling point organic solvent after or simultaneous with dispersion.

A high boiling point organic solvent utilized includes esters such as phthalic acid ester, phosphoric acid ester and aliphatic ester; higher saturated or unsaturated alcohols; alkylphenols; organic acid amides; ketones and hydrocarbon compounds.

Specific examples thereof include, for example, example compounds A-1-A-120 described in pp. 4-7, example compounds II-1-II-29 described in pp. 8-9, example compounds H-1-H-22 described in pp. 14-15, of JP-A 1-196048; example compounds S-1-S-69 described in pp. 3-7 of JP-A 1-209446, example compounds I-1-I-95 described in pp. 10-12 of JP-A 63-253943; example compounds (a-I)-(a-IX) described in p. 2 right column of U.S. Pat. No. 5,429,913; and example compounds 5-1-5-15 described in p. 22 of European Patent No. 550,359A1.

The composition of a silver halide photographic emulsion utilized in this invention may be provided with any silver halide composition of such as silver chloride, silver bromide, silver chlorobromide, silver iodobromide, silver chloroiodobromide, silver chloroiodide, however, is preferably silver chlorobromide which contains not less than 95 mol % of silver chloride and essentially no silver iodide. With respect to a rapid processing capability and processing stability, a silver halide emulsion containing preferably not less than 97 mol % and more preferably not less than 98-99.9 mol % of silver chloride is preferred.

To prepare a silver halide emulsion utilized in this invention, a silver halide emulsion provided with a portion containing silver bromide at a high concentration is specifically preferably employed. In this case, the portion containing silver bromide at a high concentration may form epitaxial connection with a silver halide emulsion particle, may be a so-called core shell emulsion, or may not form a complete layer but may be simply provided with a partial region having a different composition. Further, the composition may vary either continuously or discontinuously. The portion provided with silver bromide at a high concentration is specifically preferably the summit of a crystal particle in the surface of a silver halide emulsion.

To prepare a silver halide emulsion, it is advantageous to incorporate a heavy metal ion. Heavy metal ions, which are utilizable for this purpose, include each ion of the 8-10th group metals such as ion, iridium, platinum, palladium, nickel, rhodium, osmium, ruthenium and cobalt; the 12th group transition metals such as cadmium, zinc and mercury;

lead, rhenium, molybdenum, tungsten, gallium and chromium. Among them, metal ions of iron, iridium, platinum, ruthenium, gallium and osmium are preferable. These metal ions can be added into a silver halide emulsion as a form of salt or complex salt.

When a heavy metal ion forms a complex, the ligand or ion thereof include such as a cyanide ion, a thiocyanic acid ion, an isothiocyanic acid ion, a cyanic acid ion, a chloride ion, a bromide ion, an iodide ion, a nitric acid ion, carbonyl and ammonia. Among them, preferable are such as a cyanide ion, a thiocyanic acid ion, an isothiocyanic acid ion, a chloride ion and a bromide ion.

To incorporate a heavy metal ion in a silver halide emulsion, said heavy metal ion may be added at any portion of each process before formation of silver halide grains, during formation of silver halide grains, or during a physical ripening after formation of silver halide grains. To prepare a silver halide emulsion satisfying the aforesaid conditions, a heavy metal compound can be dissolved together with halogenide salt and continuously added over the whole or a part of the particle forming process.

The amount of a heavy metal ion when being added in a silver halide emulsion is preferably $1\times10^{-9}$-$1\times10^{-2}$ mol and specifically preferably $1\times10^{-8}$-$5\times10^{-5}$ mol, per mol of silver halide.

An arbitrary shape can be-utilized as a shape of silver halide grains of this invention. An example of preferable shapes is a cube provided with a (100) plane as the crystal surface. Further, particles having a shape of such as a octahedron, a tetradecahedron and a dodecahedron, which are prepared by a method described in such as U.S. Pat. Nos. 4,183,756 and 4,225,666; JP-A 55-26589; Examined Japanese Patent Application Publication No. (hereinafter, referred to as JP-B) 55-42737; and J. Photogr. Sci. 21, 39 (1973), can be also utilized. Further, particles having a twin plane can be also utilized.

Silver halide grains comprising a single shape are preferably utilized; however, at least two types of monodispersed silver halide emulsions are specifically preferably added in the same layer.

The particle diameter of a silver halide grains is not specifically limited, however, is in a range of preferably 0.1-1.2 μm and more preferably 0.2-1.0 μm, in view of other photographic characteristics such as a rapid processing capability and sensitivity. The particle diameter can be measured by utilizing a projection area or an approximate value of the diameter, of particles. In the case of particles are essentially comprising a uniform shape, a particle diameter distribution can be fairly accurately represented as a diameter or a projection area.

The distribution of particle diameter of silver halide grains utilized in this invention is that of monodispersed silver halide grains having a coefficient of variation of preferably not more than 0.22 and more preferably not more than 0.15, and it is specifically preferable to incorporate at least two types of monodispersed emulsions having a coefficient of variation of not more than 0.15 in the same layer. Herein, a coefficient of variation is the width of particle diameter distribution and is defined by the following equation.

Coefficient of variation=S/R (S: standard deviation of particle diameter distribution, R: mean particle diameter)

Herein, in the case of spherical silver halide grains, the particle diameter refers to a diameter thereof, and in the case of grains of such as cubic or forms other than sphere, the particle diameter refers to a diameter of a circular image having an equivalent area, to which the projected image is converted.

As a preparation apparatus and method of a silver halide emulsion, methods commonly known in the corresponding field can be utilized.

A silver halide emulsion utilized in this invention may be those prepared by any of an acid method, a neutral method or an ammonia method. Said grains may be grown at once or grown after seed grains have been formed. A method to form seed grains and to grow grains may be same or different.

Further, a reaction mode of reacting a water-soluble silver salt and a water-soluble halogenide salt may be any of a normal precipitation, reverse precipitation, simultaneous precipitation or combinations thereof, however, preferably simultaneous precipitation. Further, as one mode of simultaneous precipitation, a pAg controlled double-jet method described in such as JP-A 54-48521 can be also employed. Further, utilized may be also such as an apparatus in which aqueous solutions of a water-soluble silver salt and a water-soluble halogenide salt are supplied from an addition device arranged in a reaction mother liquid, as described in JP-A Nos. 57-92523 and 57-92524; an apparatus in which aqueous solutions of a water-soluble silver salt and a water-soluble halogenide salt are added while continuously changing the concentrations, as described in German Patent Application Publication No. 2,921,164; and an apparatus in which a reaction mother liquid is brought out of a reaction vessel and concentrated by an ultra-filtration method to perform grain formation while maintaining a constant distance between silver halide grains each other, as described in JP-B 56-501776.

Further, a silver halide solvent such as thioether may be appropriately utilized. In addition, a compound such as a compound having a mercapto group, a nitrogen-containing heterocyclic compound or a sensitizing dye may be utilized by being added at the time of silver halide grain formation or after finishing grain formation.

Silver halide emulsion may be sensitized by combination of a sensitization method by use of a gold compound and a sensitization method by use of a chalcogen sensitizer.

As applicable chalcogen sensitizers, such as a sulfur sensitizer, a selenium sensitizer and a tellurium sensitizer can be utilized, however, a sulfur sensitizer is preferable. Sulfur sensitizers include thiosulfate, allyl thiocarbamide, thiourea, allyl isothiacyanato, cystine, p-toluene thiosulfonate, rhodamine and inorganic sulfur. The addition amount of a sulfur sensitizer is preferably varied depending on types of a utilized silver halide emulsion and an expected extent of the effect, however, is generally in a range of $5\times10^{-10}$-$5\times10^{-5}$ mol and preferably in a range of $5\times10^{-8}$-$3\times10^{-5}$ mol.

As gold sensitization, a gold complex of various types such as chloroauric acid and gold sulfide can be added. A ligand compound utilized includes such as dimethylrhodanine, thiocyanic acid, mercaptotetrazole and mercaptotriazole. The using amount of a gold compound is not constant depending on such as a type of silver halide emulsion, a type of compound utilized and a ripening condition, however, is generally $1\times10^{-4}$-$1\times10^{-8}$ mol per mol of silver halide. It is more preferably $1\times10^{-5}$-$1\times10^{-8}$ mol.

As a chemical sensitization method of a silver halide emulsion, a reduction sensitization method can be also utilized.

In a silver halide emulsion, for the purpose of preventing fog which may be generated during manufacturing of a light-sensitive material, minimizing a characteristics variation during storage or preventing fog generation at the time of development, a commonly known anti-foggant and stabilizer may be utilized. Examples of compounds utilized for these purposes include compounds represented by formula (II) described on pg. 7 in the lower column of JP-A 2-146036, and more preferable specific compounds include compounds of (IIa-1)-(IIa-8) and (IIb-1)-(IIb-7) described on pg. 8 of the Patent Documents and compounds of such as 1-(3-methoxyphenyl)-5-mercaptotetrazle and 1-(4-ethoxyphenyl)-5-mercaptotetrazle.

These compounds are added at a process such as a preparation process of silver halide grains, a chemical sensitization process, finish time of chemical sensitization or a coating solution preparation process, depending on the purposes. When chemical sensitization is performed in the presence of these compounds, the amount of approximately $1\times10^{-5}$-$5\times10^{-4}$ mol per mol of silver halide is preferably utilized. When these compounds are added at finish time of chemical sensitization, the amount is preferably approximately $1\times10^{-6}$-$1\times10^{-2}$ mol and more preferably $1\times10^{-5}$-$5\times10^{-3}$ mol, per mol of silver halide. When these compounds are added in silver halide emulsion layer at a coating solution preparation process, the amount is preferably approximately $1\times10^{-6}$-$1\times10^{-1}$ mol and more preferably $1\times10^{-5}$-$1\times10^{-2}$ mol, per mol of silver halide. Further, when these compounds are added in a layer other than a silver halide emulsion layer, the amount in a coated layer is preferably approximately $1\times10^{-9}$-$1\times10^{-3}$ mol per 1 $m^2$.

In a light-sensitive material, dyes provided with absorption at various wavelength regions can be utilized for the purpose of anti-irradiation and anti-halation. For this purpose, any of commonly known compounds can be utilized, however, in particular, as a dye having absorption at a visible region, dyes of AI-1-11 described on p. 308 of JP-A 3-251840 and dyes described in JP-A 6-3770 are preferably utilized, as an infrared absorbing dye, formulas (I), (II) and (III) described at p. 2, left lower column, of JP-A 1-280750 are preferable because of preferable spectral characteristics without effects on photographic characteristics of silver halide emulsion nor contamination due to residual color. Specific examples of preferable compounds include example compounds (1)-(45) listed on pg. 3, the left lower column—pg. 5, the left lower column.

To improve sharpness, the addition amount of these dyes is preferably an amount to make an optical reflection density at 680 nm of an unprocessed light-sensitive material of preferably not less than 0.7 and more preferably not less than 0.8.

A fluorescent whitening agent is preferably incorporated in a light-sensitive material of this invention to improvement the white background. Compounds preferably utilized include those represented by formula II described in JP-A 2-232652.

In the case of utilizing a light-sensitive material of this invention as a color photographic light-sensitive material, there are provided layers containing silver halide emulsions, which are spectrally sensitized to a specific wavelength region of 400-900 nm, in combination with a yellow coupler, a magenta coupler and a cyan coupler. Said silver halide emulsion contains one or at least two types of sensitizing dyes in combination.

As a spectral sensitizing dye utilized in silver halide emulsion, any of commonly known compounds can be utilized, however, as a blue light-sensitive sensitizing dye, BS-1-8 described on pg. 28 of JP-A 3-251840 can be utilized alone or in combination. As a green light-sensitive sensitizing dye, GS-1-5 described on pg. 28 of the patent publication can be utilized. As a red light-sensitive sensitizing dye, RS-1-8 described on pg. 29 of the patent publication can be utilized. Further, when image exposure is performed with infrared light by use of such as a semiconductor laser, it is necessary to utilize an infrared light-sensitive sensitizing dye, and as an infrared light-sensitive sensitizing dye, dyes of IRS-1-11 described on pp. 6-8 of JP-A 4-285950 can be preferably utilized. Further, together with these infrared, red, green and blue light-sensitive sensitizing dyes, super sensitizers SS-1-SS-9 described on pp. 8-9 of JP-A 4-285950 and compounds S-1-S-17 described on pp. 15-17 of JP-A 5-66515 are preferably utilized in combination.

Addition timing of these sensitizing dyes may be an arbitrary timing from formation of silver halide grains to the finish of chemical sensitization. As an addition method of sensitizing dyes, the dyes may be added either as a solution, by being dissolved in a water-miscible organic solvent such as methanol, ethanol, fluoroalcohol, acetone and dimethylformamide or water, or as a solid dispersion.

In a emulsion dispersion and a light-sensitive material of this invention, a cyan dye forming coupler of this invention is utilized, and other dye forming couplers may be utilized in combination or other dye forming couplers may be utilized in a separate photographic layer other than a silver halide emulsion layer which contains a emulsion dispersion employing a dye forming coupler of this invention. To summarize these, typical dye forming couplers utilized in this invention are a yellow dye forming coupler which has the spectral absorption maximum wavelength in a wavelength region of 400-500 nm, a magenta dye forming coupler which has the spectral absorption maximum wavelength in a wavelength region of 500-600 nm, and a cyan dye forming coupler which has the spectral absorption maximum wavelength in a wavelength region of 600-750 nm.

As a yellow coupler, for example, an open-chain ketomethylene type coupler can be utilized.

Yellow couplers characterized by being represented by formula (Y-I) of JP-A 2002-311540 are preferred.

As a magenta coupler, for example, a 5-pyrazolone type coupler, a pyrazolobenzimidazole type coupler, a pyrazolotriazole type coupler and a closed-chain acylacetonitrile type coupler can be utilized.

Magenta couplers characterized by being represented by formula (M-Ia) of JP-A 2002-311540 are preferred.

Preferable surfactants, which are utilized to adjust surface tension at the time of dispersion and coating of photographic additives, include those containing a hydrophobic group having a carbon number of 8-30 and a sulfo group or salt thereof in one molecule. Specifically, listed are A-1-A-11 described in JP-A No. 64-26854. Further, surfactants, in which a fluorine atom is substituted to an alkyl group, are also preferably utilized. These dispersions are generally added in a coating solution containing a silver halide emulsion, however, time duration after dispersion until being added into a coating solution, and time duration after being added into a coating solution until being coated are preferably as short as possible; each time is preferably within 10 hours, more preferably within 3 hours and most preferably within 20 minutes.

An anti-fading agent is preferably utilized in combination with the above each coupler to prevent fading of a formed dye image by such as light, heat or humidity. Specifically preferable compounds are phenylether type compounds represented by formulas I and II described on pg. 3 of JP-A 2-66541, phenol type compounds represented by formula B described in JP-A 3-174150, amine type compounds represented by formula A described in JP-A 64-90445, and metal complexes represented by formulas XII, XIII, XIV and XV described in JP-A 62-182741, particularly for magenta dyes. Further, compounds represented by formula I' described in JP-A 1-196049, and compounds represented by formula II described in JP-A 5-11417 are preferable particularly for yellow and cyan dyes.

For the purpose of shifting the absorption wavelength of a colored dye, utilized can be compounds such as compound (d-11) described on pg. 9, the left lower column of JP-A 4-114154, and compound (A'-1) described on pg. 10, in the lower left column of the patent publication. Further, other than these, a fluorescent dye releasing compound described in U.S. Pat. No. 4,774,187 can be also utilized.

In a light-sensitive material according to this invention, a compound which reacts with a developer oxidant is preferably added in a layer between photosensitive layers to prevent color contamination or in a silver halide emulsion layer to decrease fog. Compounds for this purpose is preferably a hydroquinone derivatives and more preferably dialkylhydroquinone such as 2,5-di-t-octylhydroquinone. Specifically preferable compounds include compounds represented by formula II described in JP-A No. 4-133056, and include compounds II-1-II-14 described at pp. 13-14 and compounds 1 described at p. 17 of said patent publication.

In a light-sensitive material, gelatin is advantageously utilized as a binder, however, also appropriately utilized are hydrophilic colloid such as gelatin derivatives, graft polymer of gelatin and other polymer, protein other than gelatin, saccharide derivatives, cellulose derivatives and synthetic hydrophilic polymer substances as homopolymer or copolymer.

As a hardener for these binders, a vinylsulfon type hardener or a chlorotriazine type hardener are preferably utilized alone or in combination. Compounds described in JP-A Nos. 61-249054 and 61-245153 are preferably utilized.

Further, to prevent propagation of mold or bacteria which provides unfavorable effects to photographic characteristics and image storage stability, an antiseptic agent and an anti-mold agent as described in JP-A No. 3-157646 are preferably added in a colloid layer. In addition, to improve physical properties of a light-sensitive material or the sample surface after processing, a sliding agent and a matting agent described in JP-A Nos. 6-118543 and 2-73250 are preferably added in a protective layer.

As a support utilized for a light-sensitive material according to this invention, any material can be utilized, and utilized can be such as a paper support covered with polyethylene (PE) or polyethylene terephthalate (PET), a paper support comprising natural-pulp or synthetic pulp, a vinyl chloride sheet, a polypropyrene or PET support, which may contains a white pigment, and baryta paper. Among them, a support, in which water-resistant resin layer is provided on the both surfaces of raw paper, is preferred. Water-resistant resin is preferably PE, PET or copolymer thereof.

As white pigment, inorganic or organic white pigment can be utilized, and inorganic white pigment is preferred. Listed are sulfates of alkali earth metals such as barium sulfate, carbonates of alkali earth metals such as calcium carbonate, silicas such as micro-powder silicic acid and synthetic silicate, calcium silicate, alumina, alumina hydrate, titanium oxide, zinc oxide, talc and clay. Preferable white pigments are barium sulfate and titanium oxide.

The amount of white pigment contained in a water resistant resin layer on the surface of a support is preferably not less than 13 weight % and more preferably not less than 15 weight %, with respect to sharpness improvement.

The dispersion degree of white pigment in a water resistant resin layer of a paper support can be measured by a method described in JP-A 2-28640. When being measured by this method, a dispersion degree of white pigment is preferably not more than 0.20 and more preferably not more than 0.15, as a coefficient of variation described in the aforesaid publication.

Further, a value of a center-surface average roughness (SRa) is preferably not more than 0.15 μm and more preferably not more than 0.12 μm, because of an effect of providing excellent glossiness. Further, to adjust spectral reflective density balance or to improve whiteness of a white background after processing, a tiny amount of a bluing agent or a redness agent such as ultramarine and oil-soluble dye is preferably added in a white pigment containing water resistant resin or a coated hydrophilic colloid layer of a reflective support.

A light sensitive material may be coated on a support, the surface of which has been appropriately subjected to such as corona discharge, ultraviolet irradiation or a flame treatment, directly or via an under-coat layer (one or not less than two of under-coat layers to improve adhesion property, charging property, dimensional stability, anti-abrasion property, hardness, anti-halation property, frictional characteristics and other characteristics).

At the time of coating of a light-sensitive material utilizing a silver halide emulsion, a viscosity increasing agent may be utilized to improve coating behavior. As a coating method, extrusion coating and curtain coating, which can simultaneously coat at least two layers, are specifically preferable.

To form a photographic image by use of a light-sensitive material of this invention, an image recorded on a negative may be printed by being optically focused on a light-sensitive material to be printed; an image, which is converted once into digital information, is focused on a CRT (cathode ray tube) and said image may be focused and printed on a light-sensitive material; or printing may be performed by scanning of laser light while varying the intensity according to the digital information.

This invention is preferably applied to a light-sensitive material containing no developer in a light-sensitive material, and is specifically preferably applied to a light-sensitive material which forms an image for direct observation. For example, listed are color paper, color reversal paper, a light-sensitive material capable of forming a positive image, a light-sensitive material for display and a light-sensitive material for color proofing. This invention is specifically preferably applied to a light-sensitive material provided with a reflective support.

A light-sensitive material of this invention is subjected to a bleaching treatment and a fixing treatment after color development. A bleaching treatment and a fixing treatment may be performed simultaneously. After a fixing treatment, a washing treatment is generally performed. A stabilization treatment-may be performed instead of a washing treatment. A development apparatus utilized for development of a light-sensitive material may be either a roller transport type, in which a light-sensitive material is transported by being sandwiched between rollers arranged in a processing tank, or an endless belt type, in which a light-sensitive material is transported by being fixed to a belt, however, also utilized can be a type, in which a processing tank is formed as a slit form and a processing solution is supplied to this tank while transporting a light-sensitive material through this tank, a spray type, in which a processing solution is sprayed as a spray form, a web type, in which a light-sensitive material is contacted with a substrate being immersed in a processing solution, and a type employing a viscous processing solution. When a large amount of a light-sensitive material is processed, a light-sensitive material is generally subjected to a running processing by use of an automatic processor, and it is preferable that a replenishment amount of a replenisher is as small as possible, and the most preferable processing embodiment with respect to such as environmental adaptability is to add processing agents as a tablet form, among which a method described in Kokai-giho No. 94-16935 is most preferable.

EXAMPLE

Next, this invention will be specifically described referring to examples, however, embodiments of this invention are not limited thereto.

Example 1

(Preparation of Sample 101)

A paper support was prepared by laminating high density polyethylene on the both surfaces of paper pulp having a basis weight of 170 g/m$^2$. Herein, on the side on which an emulsion layer was coated, fused polyethylene containing anatase type titanium oxide dispersed at a content of 13 weight % was laminated, resulting in preparation of a reflection support. After this reflection support was subjected to a corona discharge treatment, a gelatin under-coat was provided and further each layer of the following composition was coated to prepare sample 101 as a silver halide color photographic light-sensitive material.

Herein, coating solutions were prepared as follows. The First Layer Coating Solution:

Yellow coupler (Y-1) of 23.4 g, 3.34 g of color image stabilizer (ST-1), 3.34 g of color image stabilizer (ST-2), 3.34 g of color image stabilizer (ST-5), 0.34 g of antistaining agent (HQ-1), 5.0 g of image stabilizer A, 5.0 g of high boiling point organic solvent (DBP) and 1.67 g of high boiling point organic solvent (DNP) were added with 60 ml of ethyl acetate to be dissolved, and the resulting solution was mixed with 320 ml of a 7% gelatin aqueous solution containing 10% of surfactant (SU-1) to be emulsifying dispersed by use of an ultrasonic homogenizer, resulting in preparation of 500 ml of yellow coupler dispersion. This dispersion, after having been mixed with a blue sensitive emulsion prepared under the following condition, was added with surfactant (SU-2) so as to make 0.765 g per L of the coating solution, resulting in preparation of the first layer coating solution.

The second-seventh layer coating solutions were also prepared in a similar manner to the first layer coating solution so as to make the coating amounts in the following table.

As a hardener, (H-1) in the second and forth layers, (H-2) in the seventh layer were added. Further, in each layer, surfactants (SU-2) and (SU-3) were added as a coating aid for surface tension control. Further, as an antiseptic agent, (F-1) was added to make the total amount of 0.04 g/m$^2$. Herein, a silver halide emulsion described below was represented by a converted value based on silver.

[Constitution of Sample 101]

| | g/m$^2$ |
|---|---|
| The 7th layer (protective layer) | |
| Gelatin | 1.00 |
| DBP | 0.002 |
| DIDP | 0.002 |
| Silicon dioxide | 0.003 |
| The 6th layer (UV absorbing layer) | |
| Gelatin | 0.40 |
| UV absorbent (UV-1) | 0.084 |
| UV absorbent (UV-2) | 0.027 |
| UV absorbent (UV-3) | 0.114 |
| Antistaining agent (HQ-5) | 0.04 |
| PVP | 0.03 |
| The 5th layer (red sensitive layer) | |
| Gelatin | 1.30 |
| Red sensitive silver halide emulsion (Em-R) | 0.21 |
| Cyan coupler (C-1) | 0.22 |
| Cyan coupler (C-1) | 0.06 |
| Color image stabilizer (ST-1) | 0.06 |
| Antistaining agent (HQ-1) | 0.004 |
| DBP | 0.10 |
| DOP | 0.20 |
| The 4th layer (UV absorbing layer) | |
| Gelatin | 0.94 |
| UV absorbent (UV-1) | 0.196 |
| UV absorbent (UV-2) | 0.063 |
| UV absorbent (UV-3) | 0.266 |
| AI-1 | 0.02 |
| Antistaining agent (HQ-5) | 0.10 |
| The 3rd layer (green sensitive layer) | |
| Gelatin | 1.30 |
| AI-2 | 0.01 |
| Green sensitive silver halide emulsion (Em-G) | 0.14 |
| Magenta coupler (M-1) | 0.20 |
| Color image stabilizer (ST-3) | 0.20 |
| Color image stabilizer (ST-4) | 0.17 |
| DIDP | 0.13 |
| DBP | 0.13 |
| The 2nd layer (intermediate layer) | |
| Gelatin | 1.20 |
| AI-3 | 0.01 |
| Antistaining agent (HQ-2) | 0.03 |
| Antistaining agent (HQ-3) | 0.03 |
| Antistaining agent (HQ-4) | 0.05 |
| Antistaining agent (HQ-5) | 0.23 |
| DIDP | 0.04 |
| DBP | 0.02 |
| Fluorescent whitening agent (W-1) | 0.10 |
| The 1st layer (blue sensitive layer) | |
| Gelatin | 1.20 |
| Blue sensitive silver halide emulsion (Em-B) | 0.26 |
| Yellow coupler (Y-1) | 0.70 |
| Color image stabilizer (ST-1) | 0.10 |
| Color image stabilizer (ST-2) | 0.10 |
| Antistaining agent (HQ-1) | 0.01 |
| Color image stabilizer (ST-5) | 0.10 |
| Image stabilizer A | 0.15 |
| DNP | 0.05 |
| DBP | 0.15 |

Support: polyethylene laminated paper (containing a slight amount of coloring agents)

Herein, the addition amount of each silver halide emulsion was represented based on a silver amount.

In the following, details of each additive utilized in preparation of above sample 101 will be shown.

DBP: dibutyl phthalate
DNP: dinonyl phthalate
DOP: dioctyl phthalate
DIDP: di-i-decyl phthalate
PVP: polyvinyl pyrrolidone
H-1: tetrakis(vinylsulfonymethyl)methane
H-2: 2,4-dichloro-6-hydroxy-s-triazine-sodium
HQ-1: 2,5-di-t-octylhydroquinone
HQ-2: 2,5-di-sec-dodecyhydroquinone
HQ-3: 2,5-di-sec-tetradecylhydroquinone
HQ-4: 2-sec-dodecyl-5-sec-tetradecylhydroquinone
HQ-5: 2,5-di[(1,1-dimethyl-4-hexyloxycarbonyl)butyl] hydroquinone
Image stabilizer A: p-t-octylphenol
SU-1: sodium tri-i-propyl-naphthalene sulfonate
SU-2: sodium di-(2-ethylhexyl)sulfosuccinate
SU-3: sodium di(2,2,3,3,4,4,5,5-octafluoropentyl)sulfosuccinate

Y-1

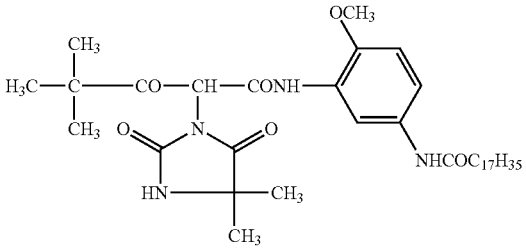

M-1

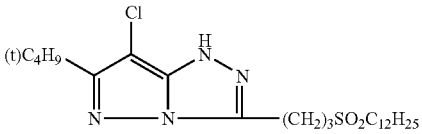

C-1

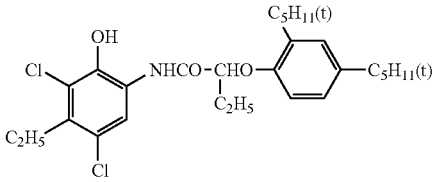

C-2

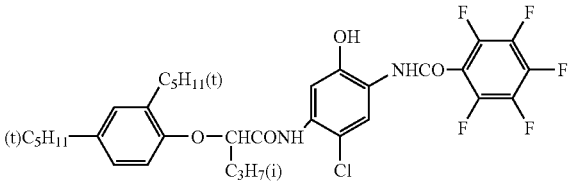

ST-1

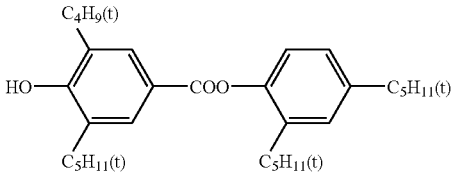

ST-2

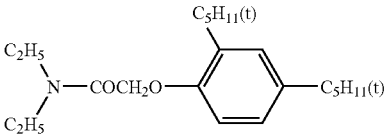

ST-3

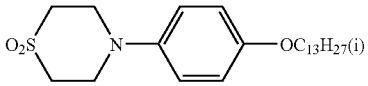

ST-4

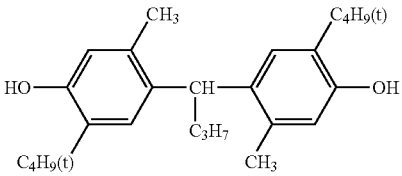

ST-5

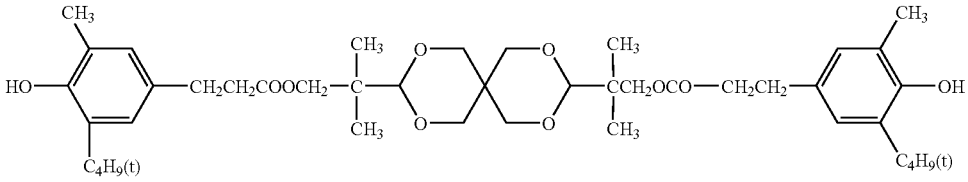

UV-1

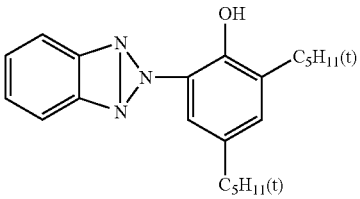

UV-2

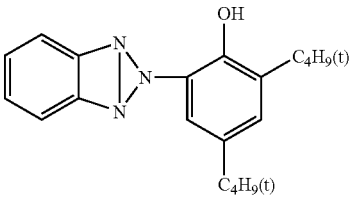

-continued

UV-3

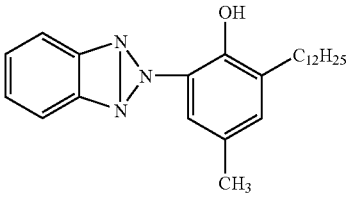

Al-1

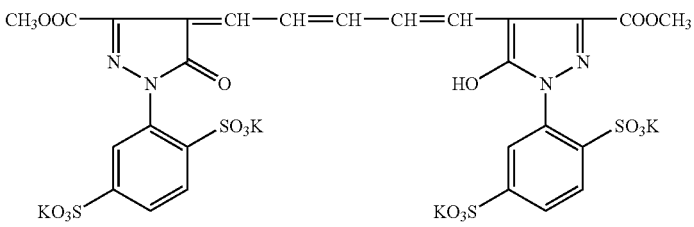

Al-2

Al-3

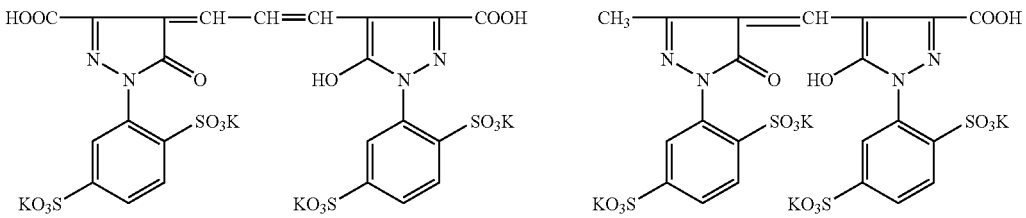

W-1

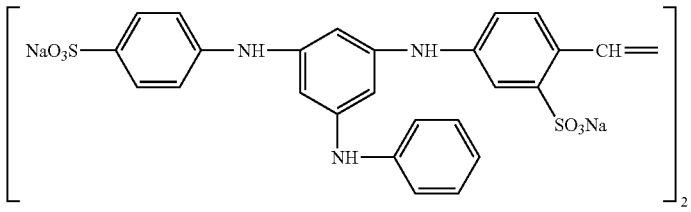

F-1

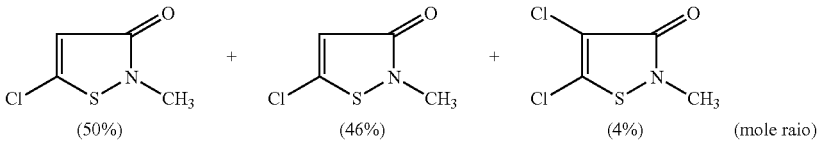

(50%) (46%) (4%) (mole raio)

[Preparation of Blue Sensitive Silver Halide Emulsion]

Following (A solution) and (B solution) were simultaneously added in 30 minutes into one litter of 2% gelatin aqueous solution being heated at 40° C. while controlling pAg=7.3 and pH=3.0, and further following (C solution) and (D solution) were added in 180 minutes while controlling pAg=8.0 and pH5.5. At this time, control of pAg was preformed by a method described in JP-A No. 59-45437, and control of pH was performed by use of a sulfuric acid or sodium hydroxide aqueous solution.

| | |
|---|---|
| (A solution) | |
| Sodium chloride | 3.42 g |
| Potassium bromide | 0.03 g |
| Addition of water to make up | 200 ml |
| (B solution) | |
| Silver nitrate | 10 g |
| Addition of water to make up | 200 ml |

-continued

| | |
|---|---|
| (C solution) | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Addition of water to make up | 600 ml |
| (D solution) | |
| Silver nitrate | 300 g |
| Addition of water to make up | 600 ml |

After finishing the addition, desalting was performed by use of a 5% aqueous solution of Demor N, manufactured by Kao Atlas Co., Ltd., and a 20% aqueous solution of magnesium sulfate, then the resulting product was mixed with a gelatin aqueous solution, resulting in preparation of monodispersed cubic emulsion EMP-1 having a mean particle diameter of 0.71 μm, a coefficient of variation of particle distribution of 0.07, and a silver chloride content of 99.5 mol %. Next, monodispersed cubic emulsion EMP-1B having a mean particle diameter of 0.64 μm, a coefficient of variation of particle distribution of 0.07, and a silver chloride content of 99.5 mol % was prepared in a similar manner to EMP-1, except that addition time of (A solution) and (B solution and), and addition time of (C solution) and (D solution) were changed.

Against above EMP-1, optimal chemical sensitization was performed by use of the following compound at 60° C. Further, after optimal chemical sensitization was performed against EMP-1B in a similar manner, sensitized EMP-1 and EMP-1B were mixed at a ratio of 1/1 based on a silver amount, resulting in preparation of blue sensitive silver halide emulsion (Em-B).

| | |
|---|---|
| Sodium thiosulfate | 0.8 mg/mol AgX |
| Auric chloride | 0.5 mg/mol AgX |
| Stabilizer: STAB-1 | $3 \times 10^{-4}$ mol/mol AgX |
| Stabilizer: STAB-2 | $3 \times 10^{-4}$ mol/mol AgX |
| Stabilizer: STAB-3 | $3 \times 10^{-4}$ mol/mol AgX |
| Sensitizing dye: BS-1 | $4 \times 10^{-4}$ mol/mol AgX |
| Sensitizing dye: BS-2 | $1 \times 10^{-4}$ mol/mol AgX |

[Preparation of Green Sensitive Silver Halide Emulsion]

Monodispersed cubic emulsion EMP-2 having a mean particle diameter of 0.40 μm, a coefficient of variation of particle distribution of 0.08, and a silver chloride content of 99.5 mol % was prepared in a similar manner to EMP-1, except that addition time of (A solution) and (B solution), and addition time of (C solution) and (D solution) were changed. Next, monodispersed cubic emulsion EMP-2B having a mean particle diameter of 0.50 μm, a coefficient of variation of particle distribution of 0.08, and a silver chloride content of 99.5 mol % was prepared in a similar manner to EMP-1, except that addition time of (A solution) and (B solution and ), and addition time of (C solution) and (D solution) were changed.

Against above EMP-2, optimal chemical sensitization was performed by use of the following compound at 55° C. Further, after optimal chemical sensitization was performed also against EMP-2B in a similar manner, sensitized EMP-2 and EMP-2B were mixed at a ratio of 1/1 based on silver amount, resulting in preparation of green sensitive silver halide emulsion (Em-G).

| | |
|---|---|
| Sodium thiosulfate | 1.5 mg/mol AgX |
| Auric chloride | 1.0 mg/mol AgX |
| Stabilizer: STAB-1 | $3 \times 10^{-4}$ mol/mol AgX |
| Stabilizer: STAB-2 | $3 \times 10^{-4}$ mol/mol AgX |
| Stabilizer: STAB-3 | $3 \times 10^{-4}$ mol/mol AgX |
| Sensitizing dye: GS-1 | $4 \times 10^{-4}$ mol/mol AgX |

[Preparation of Red Sensitive Silver Halide Emulsion]

Monodispersed cubic emulsion EMP-3 having a mean particle diameter of 0.40 μm, a coefficient of variation of particle distribution of 0.08, and a silver chloride content of 99.5 mol % was prepared in a similar manner to EMP-1, except that addition time of (A solution) and (B solution), and addition time of (C solution) and (D solution) were changed. Further, monodispersed cubic emulsion EMP-3B having a mean particle diameter of 0.38 μm, a coefficient of variation of particle distribution of 0.08, and a silver chloride content of 99.5 mol % was prepared.

Against above EMP-3, optimal chemical sensitization was performed by use of the following compound at 60° C. Further, after optimal chemical sensitization was performed also against EMP-3B in a similar manner, sensitized EMP-3 and EMP-3B were mixed at a ratio of 1/1 based on silver amount, resulting in preparation of red sensitive silver halide emulsion (Em-R).

| | |
|---|---|
| Sodium thiosulfate | 1.8 mg/mol AgX |
| Auric chloride | 2.0 mg/mol AgX |
| Stabilizer: STAB-1 | $3 \times 10^{-4}$ mol/mol Agx |
| Stabilizer: STAB-2 | $3 \times 10^{-4}$ mol/mol Agx |
| Stabilizer: STAB-3 | $3 \times 10^{-4}$ mol/mol Agx |
| Sensitizing dye: RS-1 | $1 \times 10^{-4}$ mol/mol AgX |
| Sensitizing dye: RS-2 | $1 \times 10^{-4}$ mol/mol AgX |

STAB-1: 1-(3-acetoamidephenyl)-5-mercaptotetrazole

STAB-2: 1-phenyl-5-mercaptotetrazole

STAB-3: 1-(4-ethoxyphenyl)-5-mercaptotetrazole

Further, in a red sensitive emulsion, $2.0 \times 10^{-3}$ mol of SS-1 per 1 mol of silver halide was added.

In the following, the details of each additive utilized in preparation of above each color sensitive emulsion will be shown.

BS-1

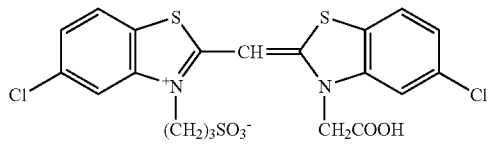

BS-2

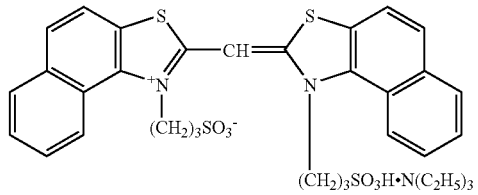

GS-1

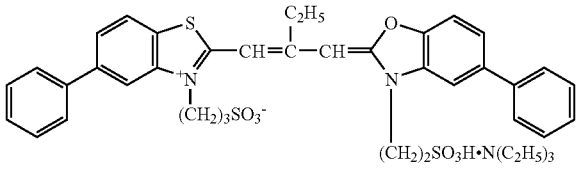

RS-1

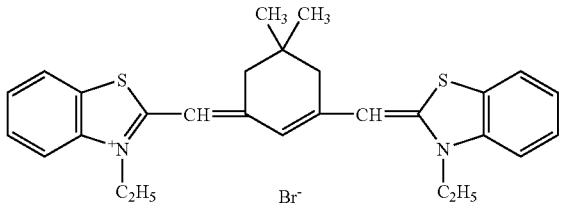

-continued

RS-2

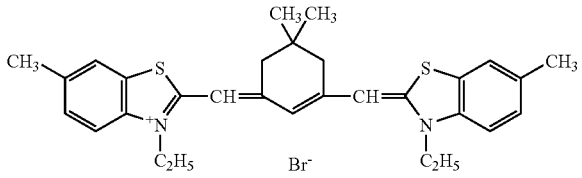

SS-1

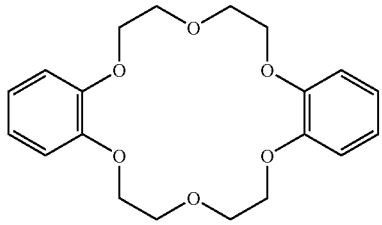

(Preparation of Samples 102-123)

Samples 102-123 comprising the constitutions described in the following table were prepared by using a cyan coupler (couplers of this invention will be shown by example compound Nos.), a color image stabilizer and a high boiling point organic solvent (organic solvents of this invention will be shown by example compound Nos.) instead of cyan couplers (C-1)/(C-2), color image stabilizer (ST-1) and high boiling point organic solvents (DBP)/(DOP) in preparation of above sample 101. (A value in the parenthesis is a coating amount g/m$^2$)

| Sample No. | Cyan coupler | Dye image stabilizer | High boiling point organic solvent | Remarks |
|---|---|---|---|---|
| 101 | C-1(0.22)/ C-2(0.06) | ST-1(0.06) | DBP(0.1)/ DOP(0.2) | Comparison |
| 102 | C-1(0.28) | — | HBS-1(0.3) | Comparison |
| 103 | C-1(0.28) | — | Image stabilizer C (0.3) | Comparison |
| 104 | C-1(0.28) | — | HBS-2(0.3) | Comparison |
| 105 | C-1(0.28) | — | A-3(0.3) | Invention |
| 106 | C-1(0.28) | — | HBS-1(0.1)/ A-3(0.2) | Invention |
| 107 | C-1(0.28) | — | A-4(0.3) | Invention |
| 108 | C-1(0.28) | — | A-12(0.3) | Invention |
| 109 | 3-5(0.28) | — | HBS-1(0.3) | Comparison |
| 110 | 3-5(0.28) | ST-3(0.06) | HBS-1(0.3) | Comparison |
| 111 | 3-5(0.28) | ST-6(0.06) | HBS-1(0.3) | Comparison |
| 112 | 3-5(0.28) | — | A-3(0.3) | Invention |
| 113 | C-1(0.22)/ 3-5(0.06) | — | HBS-1(0.3) | Comparison |
| 114 | C-1(0.22)/ 3-5(0.06) | UV-4(0.06) | HBS-1(0.3) | Comparison |
| 115 | C-1(0.22)/ 3-5(0.06) | — | A-3(0.3) | Invention |
| 116 | C-1(0.22)/ 3-5(0.06) | — | HBS-1(0.1)/ A-3(0.2) | Invention |
| 117 | C-1(0.22)/ 3-5(0.06) | — | A-4(0.3) | Invention |
| 118 | C-3(0.28) | — | HBS-1(0.3) | Comparison |
| 119 | C-3(0.28) | — | A-3(0.3) | Invention |
| 120 | C-4(0.28) | — | HBS-1(0.3) | Comparison |
| 121 | C-4(0.28) | — | A-3(0.3) | Invention |
| 122 | C-5(0.28) | — | HBS-1(0.3) | Comparison |
| 123 | C-5(0.28) | — | A-3(0.3) | Invention |

Image stabilizer C: $CH_3(CH_2)_7CH{=}CH(CH_2)_8OH$

The structures of compounds C-1-5, ST-6, UV-4, HBS-1 and HBS-2 used in the above table are shown below.

C-3

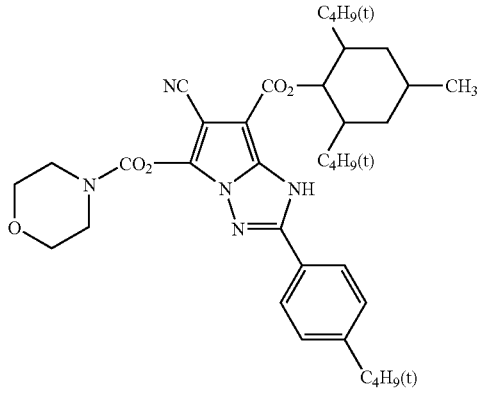

C-4

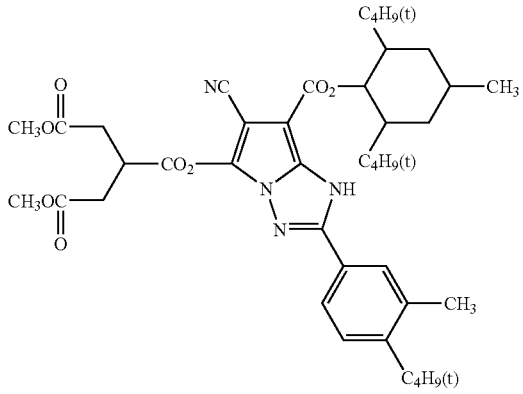

C-5

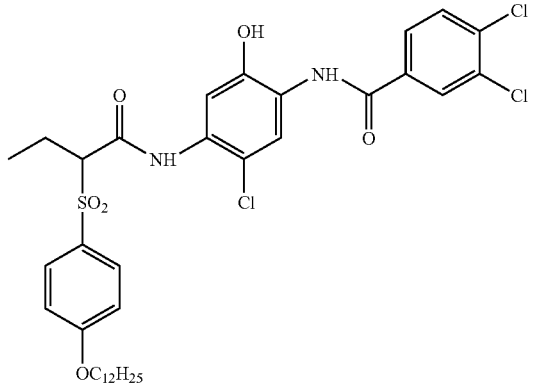

ST-6

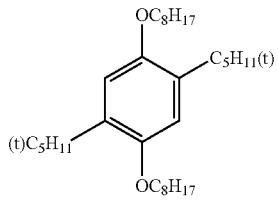

-continued

UV-4

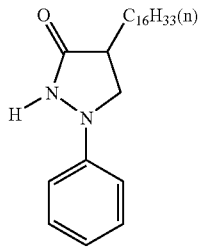

HBS-1

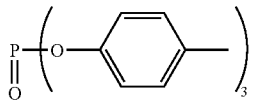

HBS-2

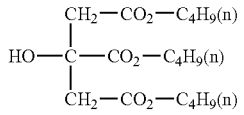

<Evaluation of Silver Halide Color Photographic Light-Sensitive Material>

With respect to each sample prepared in such a manner, a coloring capability, light fastness, processing stability and a white background were evaluated according to the following methods.

(Exposure and Development)

Each sample was wedge exposed by use of Xenon Flush High Luminance Exposing Sensitometer (manufactured by Yamashita Electric Apparatus Co., Ltd.) of $10^{-6}$ second exposure and developed according to the following processes.

| Processing step | Processing Temperature | Time | Replenishing Quantity |
|---|---|---|---|
| Color development | 38.0 ± 0.3° C. | 45 seconds | 80 ml/m$^2$ |
| Bleach and fix | 35.0 ± 0.5° C. | 45 seconds | 120 ml/m$^2$ |
| Stabilization | 30-34° C. | 60 seconds | 150 ml/m$^2$ |
| Drying | 60-80° C. | 30 seconds | — |

The compositions of the development processing solution are shown below.

[Color Development Processing Tank Solution and Replenisher]

| | Tank solution | Replenisher |
|---|---|---|
| Pure water | 800 ml | 800 ml |
| Triethylenediamine | 2 g | 3 g |
| Dithylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamideethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Penta-sodium diethylenetriamine penta-acetate | 2.0 g | 2.0 g |
| Fluorescent whitening agent (4,4-diaminostilbene disulfonate derivative) | 2.0 g | 2.5 g |
| Potassium carbonate | 30 g | 30 g |

The total volume was made up to 1 litter with addition of water and the tank solution was adjusted to pH=10.10 and the replenisher to pH=10.60.

[Bleach and Fix Tank Solution and Replenisher]

| | |
|---|---|
| Diethylenetriamine penta-acetate ferric ammonium salt dihydrate | 65 g |
| Diethylenetriamine penta-acetate | 3 g |
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |

The total amount was made up to 1 litter with water and pH was adjusted to 5.0 with sodium carbonate or glacial acetic acid.

[Stabilizer Tank Solution and Replenisher]

| | |
|---|---|
| o-phenylphenol | 1.0 g |
| 5-chloro-2-methyl-4-isothiazoline-3-one | 0.02 g |
| 2-methyl-4-isothiazoline-one | 0.02 g |
| Diethylene glycol | 1.0 g |
| Fluorescent whitening agent (Cibanol SFP) | 2.0 g |
| 1-hydroxyethylydene-1,1-diphosphorate | 1.8 g |
| Bismuth chloride (45% aqueous solution) | 0.65 g |
| Magnesium sulfate.7 hydrate | 0.2 g |
| PVP | 1.0 g |
| Ammonia water (ammonium hydroxide 25% aqueous solution) | 2.5 g |
| Tri-sodium nitrilo tri-acetate | 1.5 g |

The total amount was made up to 1 litter with water and pH was adjusted to 7.5 with sulfuric acid or ammonia water.

(Evaluation of Each Sample)

<Coloring Capability>

Maximum density of red light reflection density ($D^R_{max}$) measured-by use of PDA-65 densitometer (manufactured by Konica Corp.) of each sample was designated as a measure of a coloring capability.

<Light Fastness>

Red light reflection density before and after irradiation, when each sample was placed in an under glass out door exposure table and irradiated by sun light for 2 months, was measured by use of PDA-65 (described above). The fading degree by light (fading ratio) was determined by the following equation.

$$\text{Fading ratio } (\%)=\{(D^R_{1.0}-D^R\}/D^R_{1.0}\}\times 100$$

wherein, $D^R_{1.0}$: density before light exposure (point at 1.0), $D^R$: density after light exposure <Processing Stability>

The difference Δ ($D^R_{max}$), between the maximum density of red light reflection density ($D^R_{max}$) 4.0 of each sample, which has been processed in a similar manner except the pH of the aforesaid bleach and fix tank solution and replenisher being set to 4.0, measured by use of PDA-65 densitometer (manufactured by Konica Corp.) and the red light reflection density ($D^R_{max}$) in a ordinary processing, was designated as a measure of processing stability.

<White Background>

Each sample, which has been processed in a similar manner except the replenishing quantity of the aforesaid stabalizing process being set to 120 ml, was evaluated visually in ten grades by ten testees, and the averaged value was designated as a measure of a white background. Herein, the larger is the value, excellent is the white background, and the smaller the worse.

The evaluation results obtained are shown in the following table.

| Sample No. | Coloring Capability $D^R_{max}$ | Light fastness: Fading ratio (%) | Processing Stability: $\Delta D^R_{max}$ | White background: Visual evaluation | Remarks |
|---|---|---|---|---|---|
| 101 | 2.10 | 70 | −0.30 | 7.8 | Comparison |
| 102 | 2.11 | 79 | −0.40 | 7.4 | Comparison |
| 103 | 2.15 | 77 | −0.38 | 7.9 | Comparison |
| 104 | 2.08 | 74 | −0.41 | 7.5 | Comparison |
| 105 | 2.20 | 90 | −0.20 | 8.0 | Invention |
| 106 | 2.18 | 85 | −0.23 | 7.9 | Invention |
| 107 | 2.21 | 89 | −0.21 | 7.8 | Invention |
| 108 | 2.17 | 87 | −0.23 | 8.1 | Invention |
| 109 | 2.14 | 60 | −0.05 | 8.3 | Comparison |
| 110 | 2.13 | 70 | −0.04 | 2.8 | Comparison |
| 111 | 2.15 | 69 | −0.06 | 2.3 | Comparison |
| 112 | 2.25 | 75 | −0.01 | 8.8 | Invention |
| 113 | 2.14 | 75 | −0.15 | 8.2 | Comparison |
| 114 | 2.10 | 85 | −0.13 | 1.5 | Comparison |
| 115 | 2.25 | 90 | −0.06 | 9.0 | Invention |
| 116 | 2.22 | 83 | −0.08 | 8.8 | Invention |
| 117 | 2.24 | 89 | −0.07 | 8.6 | Invention |
| 118 | 2.11 | 58 | −0.07 | 7.4 | Comparison |
| 119 | 2.20 | 70 | −0.04 | 7.5 | Invention |
| 120 | 2.12 | 59 | −0.08 | 7.1 | Comparison |
| 121 | 2.22 | 70 | −0.05 | 7.2 | Invention |
| 122 | 2.05 | 80 | −0.06 | 7.0 | Comparison |
| 123 | 2.14 | 88 | −0.02 | 7.3 | Invention |

It is clear from the above table that a coloring capability, light fastness, processing stability and a white background are improved when a compound represented by formula (A) according to this invention is utilized. In particular, it is clear that improvement of each characteristic described above is significant when $R_{a1}$ of a compound represented by formula (A) of this invention is an alkyl group having a carbon number of 8-24 and $R_{a2}$ is an aryl group.

Example 2

Each sample prepared in example 1 was processed into a roll form having a width of 127 mm and evaluation of digital exposure adaptability was performed as follows.

A negative image of Konica Color New Centuria 400 having been developed was digitized by use of Film Scanner Qscan 1202 JW manufactured by Konica Corp., and converted into a form with which Software Photoshop (Ver. 5.5) manufactured by Adobe Corp. can deal. The image taken was added with characters and fine lines of various sizes to be made into one image data which can be exposed by such a digital scanning exposure apparatus shown below.

As light sources, 473 nm which was picked up by. wavelength conversion with SHG crystal of $KNbO_3$ from YAG solid laser (emission wavelength of 946 nm) employing a semiconductor laser GaAlAs (emission wavelength of 808.5 nm) as an excitation light source, 532 nm which was picked up by wavelength conversion with SHG crystal of KTP from $YVO_4$ solid laser (emission wavelength of 1064 nm) employing a semiconductor laser GaAlAs (emission wavelength of 808.7 nm) as an excitation light source, and AlGaInP (emission wavelength of 670 nm) were utilized. Each laser light of three colors was shifted by a polygon mirror in the direction perpendicular to the scanning direction, resulting in preparation of an apparatus which is capable of successive scanning exposure on color print paper. The exposure quantity was adjusted by electrically controlling the quantity of light of a semiconductor laser. Scanning exposure was performed at 400 dpi (wherein, dpi is a dot number per 2.54 cm) and exposure time was $5\times10^{-8}$ seconds per 1 pixel.

Each sample, after having been scanning exposed while variously adjusting the exposure quantity so as to obtain an optimal print image, was subjected to the processing of example 1 while changing the conditions as follows.

In example 1, the conditions were changed as follows.

| Processing step | Processing temperature | time | Replenishing quantity |
|---|---|---|---|
| Color development | 38.0 ± 0.3° C. | 22 seconds | 81 ml/m$^2$ |
| Bleach and fix | 35.0 ± 0.5° C. | 22 seconds | 54 ml/m$^2$ |
| Stabilization | 30-34° C. | 25 seconds | 150 ml/m$^2$ |
| Drying | 60-80° C. | 30 seconds | — |

The compositions of development processing are shown below.

<Color Development Tank Solution and Replenisher>

| | Tank solution | Replenisher |
|---|---|---|
| Pure water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamideethyl)-3-methyl-4-aminoaniline sulfate | 6.0 g | 10.5 g |
| N,N-diethylhydroxylamine | 3.5 g | 6.0 g |
| N,N-bis(2-sulfoethyl)hydroxylamine | 3.5 g | 6.0 g |
| Triethanolamine | 10.0 g | 10.0 g |
| Penta-sodium diethylenetriamine penta-acetate | 2.0 g | 2.0 g |
| Fluorescent whitening agent (4,4-diaminostilben disulfonic acid derivative) | 2.0 g | 2.5 g |
| Potassium carbonate | 30 g | 30 g |

The total volume was made up to 1 litter with addition of water, and pH of the tank solution was adjusted to 10.1 and pH of the replenisher to 10.6.

<Bleach and Fix Tank Solution and Replenisher>

| | Tank solution | Replenisher |
|---|---|---|
| Diethylenetriamine penta-acetate ferric ammonium dihydrate | 100 g | 50 g |
| Diethylenetriamine penta-acetate | 3 g | 3 ml |
| Ammonium thiosulfate (70% aqueous solution) | 200 ml | 100 ml |
| 2-amino-5-mercapto-1,3,4-thiadiazole | 2.0 g | 1.0 g |
| Ammonium sulfite (40% aqueous solution) | 50 ml | 25 ml |

The total volume was made up to 1 litter with addition of water, and pH of the tank solution was adjusted to 7.0 and pH of the replenisher to 10.6, with potassium carbonate or glacial acetic acid.

| <Stabilizer Tank Solution and Replenisher> | |
|---|---|
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Cibanol SFP) | 2.0 g |
| 1-hydroxyethylidene-1,1-diphonic acid | 1.8 g |
| PVP | 1.0 g |
| Ammonia water (ammonium hydroxide 25% aqueous solution) | 2.5 g |
| Ethylenediamine tetraacetic acid | 1.0 g |
| Ammonium sulfite (40% aqueous solution) | 10 ml |

The total volume was made up to 1 litter with addition of water, and pH was adjusted to 7.5 with sulfuric acid or ammonia water.

The obtained prints were evaluated in a similar manner to example 1 to prove that the samples of this invention reproduced excellent capabilities similar to example 1.

Example 3

Each printed image was obtained as follows, from a developed negative image of Konica Color New Centuria 400, a developed positive image of Konica Chrome Sinbi 200 High Quality and photographed image data by a digital camera, Digital Revio KD-200Z, manufactured by Konica Corp.

The sample prepared in example 1 was processed into a roll form of 127 mm width and exposed and processed by Digital Mini-Labo System QD-21Super (Print processor QDP-1500Super, employing Ecojet-HQA-P as a processing chemical, being processed according to a process named as CPK-HQA-P), to be evaluated in a similar manner to example 1. Similar to example 1, excellent results were obtained with the samples according to this invention.

Example 4

Samples 201-220 were prepared in a similar manner to example 1 according to the constitutions shown in the following table, and evaluated with respect to a coloring capability and light fastness according to similar procedure as example 1. However, as the measurement density employed was green light reflection density. (In the table, the coating amount of a magenta coupler, a dye image stabilizer and a high boiling point organic solvent were set to 0.2 g/m$^2$, 0.1 g/m$^2$, and 0.3 g/m$^2$ respectively.)

| Sample No. | Magenta coupler | Dye image stabilizer | High boiling point organic solvent | Remarks |
|---|---|---|---|---|
| 201 | M-1 | ST-3 | DIDP | Comparison |
| 202 | M-1 | ST-3 | Image stabilizer C | Comparison |
| 203 | M-1 | ST-3 | HBS-1 | Comparison |
| 204 | M-1 | ST-3 | A-1 | Invention |
| 205 | M-1 | ST-3 | A-2 | Invention |
| 206 | M-1 | ST-3 | A-3 | Invention |
| 207 | M-1 | ST-3 | A-4 | Invention |
| 208 | M-2 | ST-3 | HBS-1 | Comparison |
| 209 | M-2 | ST-3 | A-3 | Invention |
| 210 | M-2 | ST-3 | A-4 | Invention |
| 211 | M-3 | ST-3 | HBS-1 | Comparison |
| 212 | M-3 | ST-3 | A-3 | Invention |
| 213 | M-3 | ST-3 | A-5 | Invention |

-continued

| Sample No. | Magenta coupler | Dye image stabilizer | High boiling point organic solvent | Remarks |
|---|---|---|---|---|
| 214 | M-3 | ST-3 | A-6 | Invention |
| 215 | M-4 | ST-3 | HBS-1 | Comparison |
| 216 | M-4 | ST-3 | A-3 | Invention |
| 217 | M-4 | ST-3 | A-7 | Invention |
| 218 | M-4 | ST-3 | A-8 | Invention |
| 219 | M-5 | ST-3 | HBS-1 | Comparison |
| 220 | M-5 | ST-3 | A-3 | Invention |

In the table, the following compounds were utilized as magenta couplers represented by M-2, M-3, M-4 and M-5.

M-2

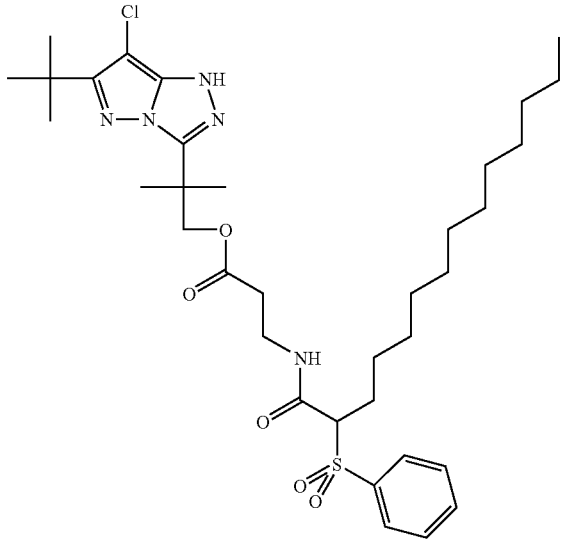

M-3

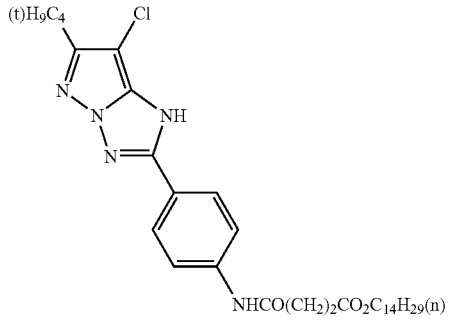

M-4

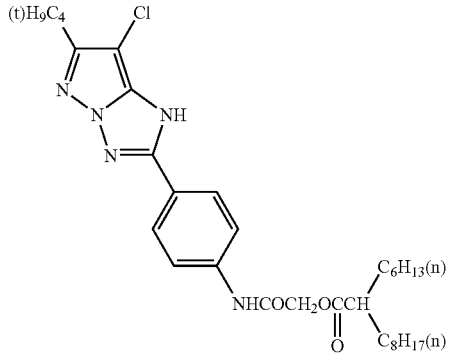

-continued

M-5

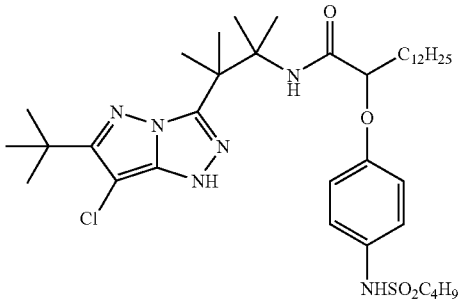

The obtained results are shown in the following table.

| Sample No. | Coloring capability $D^G_{max}$ | Light fastness Fading ratio (%) | Remarks |
|---|---|---|---|
| 201 | 2.20 | 60 | Comparison |
| 202 | 2.25 | 65 | Comparison |
| 203 | 2.18 | 62 | Comparison |
| 204 | 2.31 | 70 | Invention |
| 205 | 2.30 | 72 | Invention |
| 206 | 2.36 | 76 | Invention |
| 207 | 2.35 | 75 | Invention |
| 208 | 2.31 | 75 | Comparison |
| 209 | 2.44 | 91 | Invention |
| 210 | 2.46 | 90 | Invention |
| 211 | 2.18 | 80 | Comparison |
| 212 | 2.32 | 90 | Invention |
| 213 | 2.30 | 88 | Invention |
| 214 | 2.30 | 88 | Invention |
| 215 | 2.20 | 78 | Comparison |
| 216 | 2.31 | 88 | Invention |
| 217 | 2.29 | 89 | Invention |
| 218 | 2.28 | 88 | Invention |
| 219 | 2.25 | 73 | Comparison |
| 220 | 2.40 | 86 | Invention |

It is clear from the above table that a coloring capability and light fastness have been improved by utilizing compounds represented by formula (A) according to this invention. In particular, it is clear that improvement of each characteristic described above is significant when $R_{a1}$ of a compound represented by formula (A) of this invention is an alkyl group having a carbon number of 8-24 and $R_{a2}$ is an aryl group.

Example 5

Samples 301-312 were prepared in a similar manner to example 1 according to the constitutions shown in the following table, and evaluated with respect to a coloring capability and light fastness according to similar procedure to example 1. However, as the measurement density employed was blue light reflection density. (In the table, the coating amount of a yellow coupler, a dye image stabilizer and a high boiling point organic solvent were set to 0.45 g/m$^2$, 0.04 g/m$^2$, and 0.2 g/m$^2$, respectively.)

| Sample No. | Yellow coupler | Dye image stabilizer | High boiling point organic solvent | Remarks |
|---|---|---|---|---|
| 301 | Y-2 | Image stabilizer B | DBP | Comparison |
| 302 | Y-2 | Image stabilizer B | HBS-1 | Comparison |
| 303 | Y-2 | Image stabilizer B | A-3 | Invention |
| 304 | Y-2 | Image stabilizer B | A-4 | Invention |
| 305 | Y-4 | Image stabilizer B | DBP | Comparison |
| 306 | Y-4 | Image stabilizer B | HBS-1 | Comparison |
| 307 | Y-4 | Image stabilizer B | A-3 | Invention |
| 308 | Y-4 | Image stabilizer B | A-4 | Invention |
| 309 | Y-3 | Image stabilizer B | DBP | Comparison |
| 310 | Y-3 | Image stabilizer B | HBS-1 | Comparison |
| 311 | Y-3 | Image stabilizer B | A-3 | Invention |
| 312 | Y-3 | Image stabilizer B | A-4 | Invention |

Herein, poly(t-butylacrylamide) was utilized as image stabilizer B and the following compounds as Y-2, Y-3 and Y-4.

Y-2

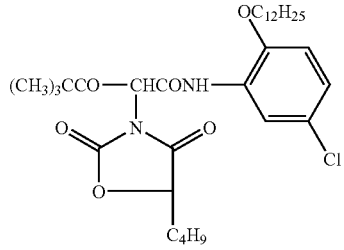

Y-3

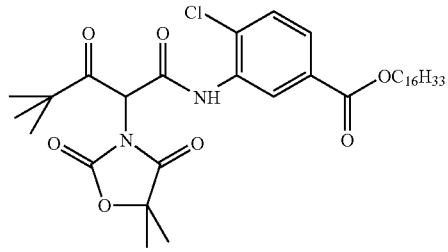

Y-4

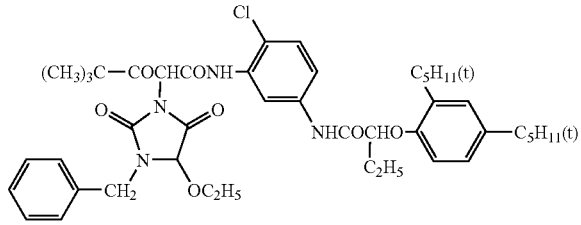

The obtained results are shown in the following table.

| Sample No. | Coloring capability: $D^B_{max}$ | Light fastness: Fading ratio (%) | Remarks |
|---|---|---|---|
| 301 | 2.10 | 70 | Comparison |
| 302 | 2.05 | 75 | Comparison |
| 303 | 2.24 | 82 | Invention |
| 304 | 2.23 | 81 | Invention |
| 305 | 2.08 | 73 | Comparison |
| 306 | 2.04 | 75 | Comparison |

-continued

| Sample No. | Coloring capability: $D^B_{max}$ | Light fastness: Fading ratio (%) | Remarks |
|---|---|---|---|
| 307 | 2.21 | 83 | Invention |
| 308 | 2.20 | 84 | Invention |
| 309 | 2.13 | 65 | Comparison |
| 310 | 2.08 | 68 | Comparison |
| 311 | 2.22 | 78 | Invention |
| 312 | 2.21 | 80 | Invention |

It is clear from the table that a coloring capability and light fastness have been improved by utilizing compounds represented by formula (A) according to this invention. In particular, it is clear that improvement of each characteristic described above is significant when $R_{a1}$ of a compound represented by formula (A) of this invention is an alkyl group having a carbon number of 8-24 and $R_{a2}$ is an aryl group.

POSSIBLE INDUSTRIAL APPLICATIONS

As described above, a constitution defined in this invention can provide a color material and a silver halide color photographic light-sensitive material which are excellent in coloring capability, processing stability, dye image fastness and white background.

What is claimed is:

1. A color material comprising a reflective or a transparent support having thereon a layer comprising a compound represented by formula (A):

Formula (A)

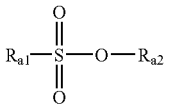

wherein, $R_{a1}$ is an alkyl group having 8-24 carbon atoms, and the alkyl group may be further provided with a substituent; and $R_{a2}$ is an alkyl group, a cycloalkyl group, an alkenyl group, an aryl group or a heterocyclic group, provided that each group may be further provided with a substituent.

2. A silver halide color photographic light-sensitive material comprising a reflective or a transparent support having layers thereon, wherein a light-sensitive silver halide emulsion is contained in at least one of the layers, and a compound represented by formula (A) is contained in at least one of the layers:

Formula (A)

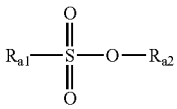

wherein, $R_{a1}$ is an alkyl group having 8-24 carbon atoms, and the alkyl group may be further provided with a substituent; and $R_{a2}$ is an alkyl group, a cycloalkyl group, an alkenyl group, an aryl group or a heterocyclic group, provided that each group may be further provided with a substituent.

3. The silver halide color photographic light-sensitive material of claim 2, wherein $R_{a2}$ is a substituted or unsubstituted aryl group.

4. The silver halide color photographic light sensitive material of claim 2 further comprising a yellow dye forming coupler, a magenta dye forming coupler or a cyan dye forming coupler in at least one layer.

5. The silver halide color photographic light-sensitive material of claim 4, further comprising at least one of couplers represented by formula (I):

Formula (I)

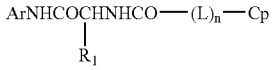

wherein, Ar is an aryl group or a heterocyclic group, $R_1$ is an alkyl group, an aryl group or a heterocyclic group; L is a divalent linking group end n is an integer of 0 or 1; and Cp is a coupler residual group.

6. The silver halide color photographic light-sensitive material of claim 4 further comprising at least one type of couplers represented by formula (II):

Formula (II)

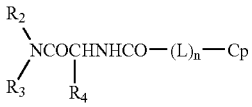

wherein, $R_1$, $R_2$, and $R_3$ are each an alkyl group, an aryl group or a heterocyclic group; L is a divalent connecting group; n is an integer of 0 or 1; and Cp is a coupler residual group.

7. The silver halide color photographic light-sensitive material of claim 4 further comprising at least one type of couplers represented by formula (III):

Formula (III)

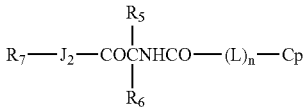

wherein, $R_5$ is an unsubstituted alkyl group having a carbon number of not less Than 5; $R_6$ is a hydrogen atom, an alkyl group, an aryl group or a heterocyclic group; $R_7$ is an alkyl group, an aryl group or a heterocyclic group; J is —O— or —$NR_{11}$—; $R_{11}$ is a hydrogen atom, an alkyl group, an aryl group or a heterocyclic group; L is a divalent connecting group; n is an integer of 0 or 1; and Cp is a coupler residual group.

8. The silver halide color photographic light-sensitive material of claim 4, wherein the coupler residual group Cp of formula (I), formula (II) or formula (III) is represented by formula (IV):

Formula (IV)

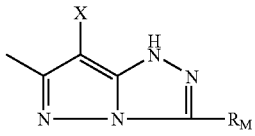

wherein, X is a hydrogen atom, a halogen atom or a group, which is released by coupling with an oxidant of a color developing agent; and $R_M$ is a mono-valent substituent.

9. The silver halide color photographic light-sensitive material of claim 8, wherein a phenol type cyan coupler is contained in the same layer containing a coupler provided with a coupler residual group represented by formula (IV).

10. A color material comprising a reflective or a transparent support having thereon a layer comprising a compound represented by formula (A) wherein formula A is represented by one of the following formulas:

A-1

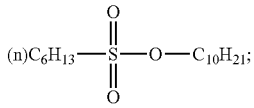

A-2

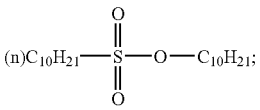

A-3

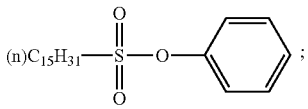

A-4

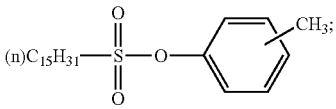

A-5

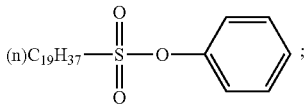

A-6

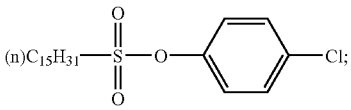

A-7

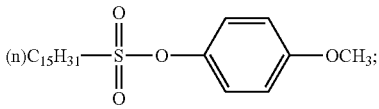

A-8

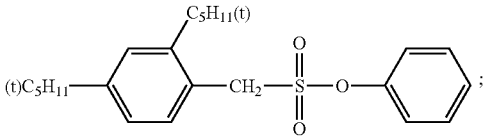

A-9

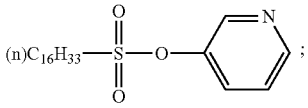

A-10

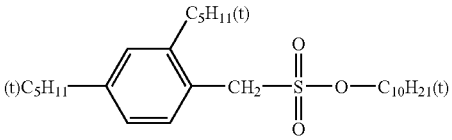

-continued

A-11

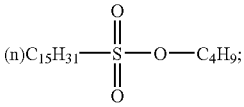

A-12

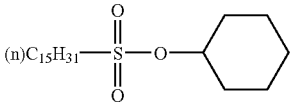

A-13

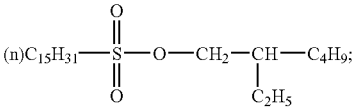

A-14

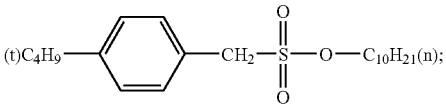

A-15

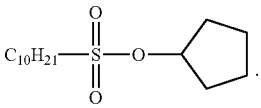

11. The silver halide color photographic light-sensitive material of claim 10, further comprising a yellow dye forming coupler, a magenta dye forming coupler or a cyan dye forming coupler in at least one layer.

12. The silver halide color photographic light-sensitive material of claim 11, further comprising at least one of couplers represented by formula (I):

Formula (I)

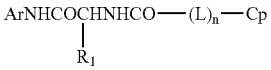

wherein, Ar is an aryl group or a heterocyclic group, $R_1$ is an alkyl group, an aryl group or a heterocyclic group; L is a divalent linking group and n is an integer of 0 or 1; and Cp is a coupler residual group.

13. The silver halide color photographic light-sensitive material of claim 11, further comprising at least one type of at least one type of couplers represented by formula (II):

Formula (II)

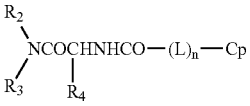

wherein, $R_1$, $R_2$, and $R_3$ are each an alkyl group, an aryl group or a heterocyclic group; L is a divalent connecting group; n is an integer of 0 or 1; and Cp is a coupler residual group.

14. The silver halide color photographic light-sensitive material of claim 11, further comprising at least one type of couplers represented by formula (III):

Formula (III)

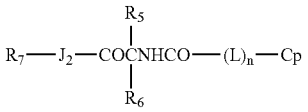

wherein, $R_5$ is an unsubstituted alkyl group having a carbon number of not less than 5; $R_6$ is a hydrogen atom, an alkyl group, an aryl group or a heterocyclic group; $R_7$ is an alkyl group, an aryl group or a heterocyclic group; J is —O— or —$NR_{11}$—; $R_{11}$ is a hydrogen atom, an alkyl group, an aryl group or a heterocyclic group; L is a divalent connecting group; n is an integer of 0 or 1; and Cp is a coupler residual group.

15. The silver halide color photographic light-sensitive material of claim 11, wherein the coupling residential group CP of formula (I), formula (II) or formula (III) is represented by formula (IV):

Formula (IV)

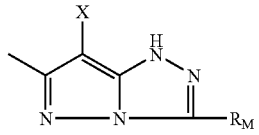

wherein, X is a hydrogen atom, a halogen atom or a group, which is released by coupling with an oxidant of a color developing agent; and $R_M$ is a mono-valent substituent.

16. The silver halide color photographic light-sensitive material of claim 15, wherein a phenyl type cyan coupler is contained in the same layer containing a coupler provided with a coupler residual group represented by formula (IV).

* * * * *